US007287930B2

(12) United States Patent
Yamasaki et al.

(10) Patent No.: US 7,287,930 B2
(45) Date of Patent: Oct. 30, 2007

(54) VEHICLE IMPACT ATTENUATOR

(75) Inventors: Sei Yamasaki, Osaka (JP); Takamasa Nakajima, Izumi (JP)

(73) Assignees: NKC CO., Ltd., Osaka (JP); Osaka Prefectural Government, Osaka (JP); Hiraoka & Co., Ltd., Ibaraki (JP)

( * ) Notice: Subject to any disclaimer, the term of this patent is extended or adjusted under 35 U.S.C. 154(b) by 70 days.

(21) Appl. No.: 10/520,281

(22) PCT Filed: Jul. 29, 2004

(86) PCT No.: PCT/JP2004/011214

§ 371 (c)(1),
(2), (4) Date: Jan. 28, 2005

(87) PCT Pub. No.: WO2005/035877

PCT Pub. Date: Apr. 21, 2005

(65) Prior Publication Data

US 2006/0099030 A1 May 11, 2006

(30) Foreign Application Priority Data

Oct. 8, 2003 (JP) ..... 2003-350059

(51) Int. Cl.
*E01F 9/018* (2006.01)

(52) U.S. Cl. ..... 404/10; 404/6; 404/9

(58) Field of Classification Search ..... 404/6, 404/9, 10; 256/13.1

See application file for complete search history.

(56) References Cited

U.S. PATENT DOCUMENTS 3,093,230 A * 6/1963 Byers ..... 400/330.8
3,308,584 A * 3/1967 Graham ..... 52/98
3,602,109 A * 8/1971 Harrington ..... 256/13.1
3,717,326 A * 2/1973 Leach et al. ..... 256/13.1
3,838,661 A * 10/1974 Medley, Jr. ..... 116/63 P
3,880,404 A * 4/1975 Fitch ..... 256/1
3,972,107 A * 8/1976 Deike ..... 29/402.19

(Continued)

FOREIGN PATENT DOCUMENTS

JP 10-176314 6/1998

(Continued)

OTHER PUBLICATIONS

International Search Report dated Nov. 2, 2004.

*Primary Examiner*—Raymond W. Addie
(74) *Attorney, Agent, or Firm*—Kratz, Quintos & Hanson, LLP

(57) ABSTRACT

A vehicle impact attenuator that can be installed at low cost in a narrow installation space, immediately stop a colliding vehicle, and effectively mitigate the impact on the vehicle. The vehicle impact attenuator includes a shock absorber that deforms upon a collision by a vehicle to reduce the impact on the vehicle. A support is provided for the shock absorber and a holding portion holds the support (20A) in a vertical position in an installation area. The support has cuts made in it that upon application of a load equal to or exceeding a set value, fracture and function as a release mechanism to thereby release the support from being held in a vertical position in the installation area. The support is deformable by a load less than the set value.

10 Claims, 17 Drawing Sheets

U.S. PATENT DOCUMENTS

| | | | | | |
|---|---|---|---|---|---|
| 4,106,879 | A | * | 8/1978 | Diedershagen et al. | 404/10 |
| 4,183,505 | A | * | 1/1980 | Maestri | 256/13.1 |
| 4,290,585 | A | * | 9/1981 | Glaesener | 256/13.1 |
| 4,373,464 | A | * | 2/1983 | Blau | 116/63 R |
| 4,432,172 | A | * | 2/1984 | Kuykendall et al. | 52/98 |
| 4,784,515 | A | * | 11/1988 | Krage et al. | 404/6 |
| 5,207,175 | A | * | 5/1993 | Andonian | 116/209 |
| 5,597,262 | A | * | 1/1997 | Beavers et al. | 404/6 |
| 5,703,577 | A | * | 12/1997 | Carter | 340/908 |
| 5,809,733 | A | * | 9/1998 | Venegas, Jr. | 52/721.5 |
| 6,059,487 | A | * | 5/2000 | Haga et al. | 404/6 |
| 6,454,488 | B1 | * | 9/2002 | Lewis et al. | 404/6 |
| 6,502,805 | B2 | * | 1/2003 | Lewis et al. | 256/13.1 |
| 6,520,711 | B2 | * | 2/2003 | Kim | 404/6 |

FOREIGN PATENT DOCUMENTS

| | | |
|---|---|---|
| JP | 10-292330 | 11/1998 |
| JP | 2000-192432 | 7/2000 |
| JP | 2001-159107 | 6/2001 |
| JP | 2003-064629 | 3/2003 |

* cited by examiner (a)

(b)

(a)

(b)

(a)

(b)

VEHICLE IMPACT ATTENUATOR

TECHNICAL FIELD

The present invention relates to a vehicle impact attenuator to be installed on or in the vicinity of roads where vehicle collisions are liable to occur, in order to immediately stop a colliding vehicle and mitigate the impact applied to the vehicle.

BACKGROUND ART

Vehicle impact attenuators are installed in places where vehicle collisions tend to occur, such as the ends of median strips, road forks, and the ends of branch points for tollgates, in order to immediately stop a colliding vehicle and mitigate the impact applied to the vehicle, thereby preventing secondary accidents and reducing damage to the vehicle and its occupants.

Guard fences, such as steel guardrails or guard cables, can be described as vehicle impact attenuators. However, with these devices, colliding vehicles still receive a large impact, and the damage to the occupants and vehicles cannot be effectively inhibited. Further, these devices are likely to greatly damage the colliding vehicles and the scattered fragments are liable to cause secondary accidents.

Other vehicle impact attenuators include water-filled container-type impact attenuators. However, this type of devices also pose a problem in that a vehicle receives a large impact when it collides with them while traveling at a high speed. Further, containers knocked over by a vehicle may scatter on the road, or a colliding vehicle may not be decelerated even after knocking down the containers and may jump over the base of the containers into the opposite lane, causing secondary accidents.

In view of such problems, the present inventors conducted extensive research and proposed vehicle impact attenuators that comprise a shock absorber and a support fixed on the ground so as to support the shock absorber, wherein the support is released from the ground and made slidably movable when a load exceeding a set value is applied by a vehicle collision (Japanese Unexamined Patent Publication No. 2001-159107, hereinafter "Publication 1", and Japanese Unexamined Patent Publication No. 2003-64629, hereinafter "Publication 2"). The proposed devices make it possible to effectively absorb the impact, immediately stop the vehicle, and prevent the vehicle from receiving an impact load exceeding a set value.

However, since vehicle impact attenuators are generally installed in narrow places with limited space, such as the ends of median strips, the devices must be miniaturized or improved in impact load absorbing capacity per installation space, so as to allow a smooth traffic flow and make the devices installable in more places. Moreover, the installation cost of vehicle impact attenuators must be reduced in order to make the devices installable in many places.

DISCLOSURE OF THE INVENTION

A first object of the present invention is to provide a vehicle impact attenuator that can be installed in a narrow place with limited space, immediately stop a colliding vehicle, and effectively mitigate the impact received by the vehicle. A second object of the present invention is to provide a vehicle impact attenuator that can be installed at low cost.

To achieve the above objects, a first vehicle impact attenuator of the present invention comprises:

a shock absorber that deforms upon a collision of a vehicle to thereby reduce the impact on the vehicle;

a support for the shock absorber;

a holding portion that holds the support in a vertical position in an installation area;

the support or holding portion having a release portion that fractures upon application of a load equal to or exceeding a set value to thereby release the support from being held in a vertical position in the installation area, and the support being plastically deformable by a load lower than the set value.

A second vehicle impact attenuator of the present invention is characterized in that the support in the first vehicle impact attenuator is a pipe-like member; the holding portion comprises a connecting portion fixed on a lower part of the support, and anchor bolts that are implanted in the installation area to thereby hold the connecting portion in the installation area and that function as the release portion; and the anchor bolts fracture upon application of a load equal to or exceeding the set value.

A third vehicle impact attenuator of the present invention is characterized in that the holding portion in the first vehicle impact attenuator comprises a burying hole formed in the installation area to accommodate a lower part of the support; the support is a pipe-like or rod-like member and has cuts that are positioned above the installation area when the support is accommodated in the burying hole; and the cuts serve as fracture starting points when a load equal to or exceeding the set value is applied, and function as the release portion.

A fourth vehicle impact attenuator of the present invention is characterized in that the support in the third vehicle impact attenuator is a pipe-like member, and the plastic deformation occurs as flattening of the pipe-like member.

A fifth vehicle impact attenuator of the present invention is characterized in that a coil that is plastically deforms upon application of a load equal to or exceeding a predetermined value is further provided to the first vehicle impact attenuator; the holding portion has a burying hole formed in the installation area to accommodate a lower part of the support; the support is a pipe-like member and plastically deforms upon application of a load lower than the set value; the ends of the coil are disposed above and below the release portion and attached to an upper part of the support, which is released by the vehicle collision, and to the holding portion or a lower part of the support, which remains held after the vehicle collision.

A sixth vehicle impact attenuator of the present invention is characterized in that the coil in the fifth vehicle impact attenuator has a helical shape having a plurality of turns each of which is an approximate circle with a coil diameter of not less than 110 mm and not more than 130 mm, a wire diameter of not less than 30 mm and not more 40 mm, and a number of turns of not less than 3 and not more than 20, and is made of structural steel.

A seventh vehicle impact attenuator of the present invention is characterized in that the support in the first vehicle impact attenuator is comprised of a plurality of the supports that are held adjacent to each other in the installation area, and the shock absorber is supported by all of the supports.

An eighth vehicle impact attenuator of the present invention is characterized in that the holding portion in any one of the third, fourth or fifth vehicle impact attenuators is accommodated in the burying hole and comprises a fitting member that engages and holds a lower part of the support, the fitting member has strength sufficient to approximately retain its original shape after the fracture of the release portion.

A ninth vehicle impact attenuator of the present invention is characterized in that the set value at which the release portion fractures in any one of the second, fourth or fifth vehicle impact attenuators, is not less than 50 kN and not more than 900 kN, and the yield point load that causes the flattening as the plastic deformation of the support is not less than 25 kN and not more than 800 kN.

A tenth vehicle impact attenuator of the present invention is characterized in that, the pipe-like member in the ninth vehicle impact attenuator is formed using iron or plastic, has an outer diameter of not less than 100 mm and not more than 800 mm, and a wall thickness of not less than 0.8 mm and not more than 100 mm.

An eleventh vehicle impact attenuator of the present invention is characterized in that the pipe-like member in any of the second, fourth or fifth vehicle impact attenuators contains an internal cushioning material.

In the first vehicle impact attenuator, at the time of a vehicle collision, the impact is first absorbed by the deformation of the shock absorber, then by the plastic deformation of the support, and then by the fracture of the release portion. When the load equals to or exceeds the set value, the release portion breaks to release the support, so that the impact on the vehicle can be limited to a predetermined value. Thus, the vehicle impact attenuator absorbs impact by plastic deformation of the support in addition to the buffering actions of the shock absorber and release portion. Accordingly, the attenuator has an impact load absorbing capacity that is higher than that achieved by the flexibility of the shock absorber, due to the contribution of the plastic deformation of the support. Since the support does not increase the volume of the vehicle impact attenuator, the attenuator has a higher impact load absorbing capacity per installation area than known vehicle impact attenuators. Therefore, the vehicle impact attenuator of the present invention is installable in a narrow space with limited space, effectively mitigates the impact received by a colliding vehicle, and immediately stop the vehicle. In particular, when two or more vehicle impact attenuators are installed side by side so that, on release of the support of one attenuator, the colliding vehicle impacts with the subsequent attenuator, the use of the first vehicle impact attenuators can decrease the number of attenuators that need to be installed, thereby greatly reducing the necessary installation space.

In the second vehicle impact attenuator, the use of anchor bolts that break upon application of a load equal to or exceeding a set value easily realizes a release portion that releases the support.

In the third vehicle impact attenuator, the support and holding portion are integrally formed as one pipe-like member, and the cuts formed on the support and serving as a release portion simplify the structure of the release portion, thereby reducing the production cost. Further, the support can be erected and fixed simply by inserting a lower part of the support in a burying hole provided in the installation area, making the installation operation easy and the installation cost low. Furthermore, the above structure enables installation in a narrow space. Moreover, the yield point load of the release portion can be varied with the shape of the cuts and therefore the breaking strength can be easily set at an optimum value, and thus a vehicle impact attenuator can be easily provided which has a release portion with a breaking strength suitable for the conditions of the installation site.

In the fourth vehicle impact attenuator, a pipe-like member is used as the support. Thus, to mitigate the impact by plastic deformation, the support is dented in the direction of the collision and then flattened by expansion of the dent in a direction approximately perpendicular to the direction of the collision. The flattening, in combination with the bending in the vertical direction, flexibly absorb the impact in the direction of the collision. Moreover, since the flattening does not depend on the direction of the collision, the buffering action is stabilized. Furthermore, a general-purpose pipe-like member can be used, lowering the production cost.

In the fifth and sixth vehicle impact attenuators, the coil continuously absorbs the impact even after an upper part of the support has been separated by a vehicle collision.

The seventh vehicle impact attenuator comprises a plurality of supports, and thus the plastic deformation of the supports greatly contributes to increase the impact load absorbing capacity. Further, such a structure dissipates the load received by a colliding vehicle.

In the eighth vehicle impact attenuator, even when a load equal to or exceeding the set value is applied at the time of vehicle collision, the impact is concentrated in the region with cuts, which has lower strength than the fitting member. The region with cuts can be smoothly broken, thereby effectively inhibiting damage to the fitting member. Accordingly, after a vehicle collision, the vehicle impact attenuator can be easily withdrawn since the base for installation of the attenuator can be recovered by simply removing the remains inside and around the fitting member. Moreover, the fitting member is reusable and simplifies the installation of a new vehicle impact attenuator. This reduces restoration cost as well as installation cost, and also decreases the necessary work time.

In the ninth vehicle impact attenuator, the set value and yield point load are adjusted to a value in the prescribed range, whereby the effects described above are remarkably exhibited.

In the tenth vehicle impact attenuator, the yield point load of the pipe-like member can be adjusted to a value in the prescribed range.

The eleventh vehicle impact attenuator comprises an internal cushioning material that contributes to impact absorption when the pipe-like member is flattened. The impact absorbing capacity of the pipe-like member can be easily optimized by appropriately selecting the presence or absence of the internal cushioning material, and the form or quality of the internal cushioning material. Thus, a vehicle impact attenuator with an impact absorbing capacity suitable for the conditions of the installation site can be easily provided.

BEST MODE FOR CARRYING OUT THE INVENTION

Embodiments of the present invention are described below, referring to the accompanying drawings.

First Embodiment

Figure 1:
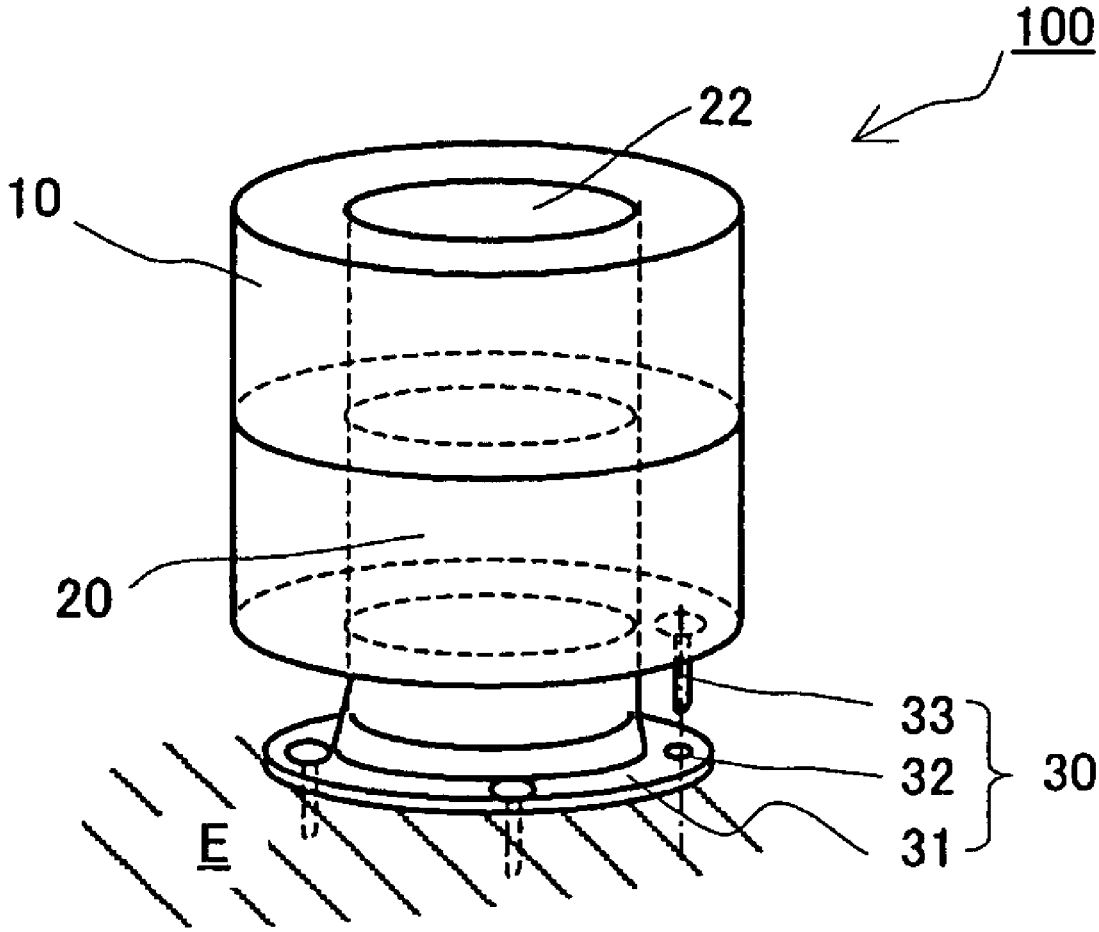
FIG. 1 is a perspective view illustrating a vehicle impact attenuator according to a first embodiment of the present invention.
Figure 2:
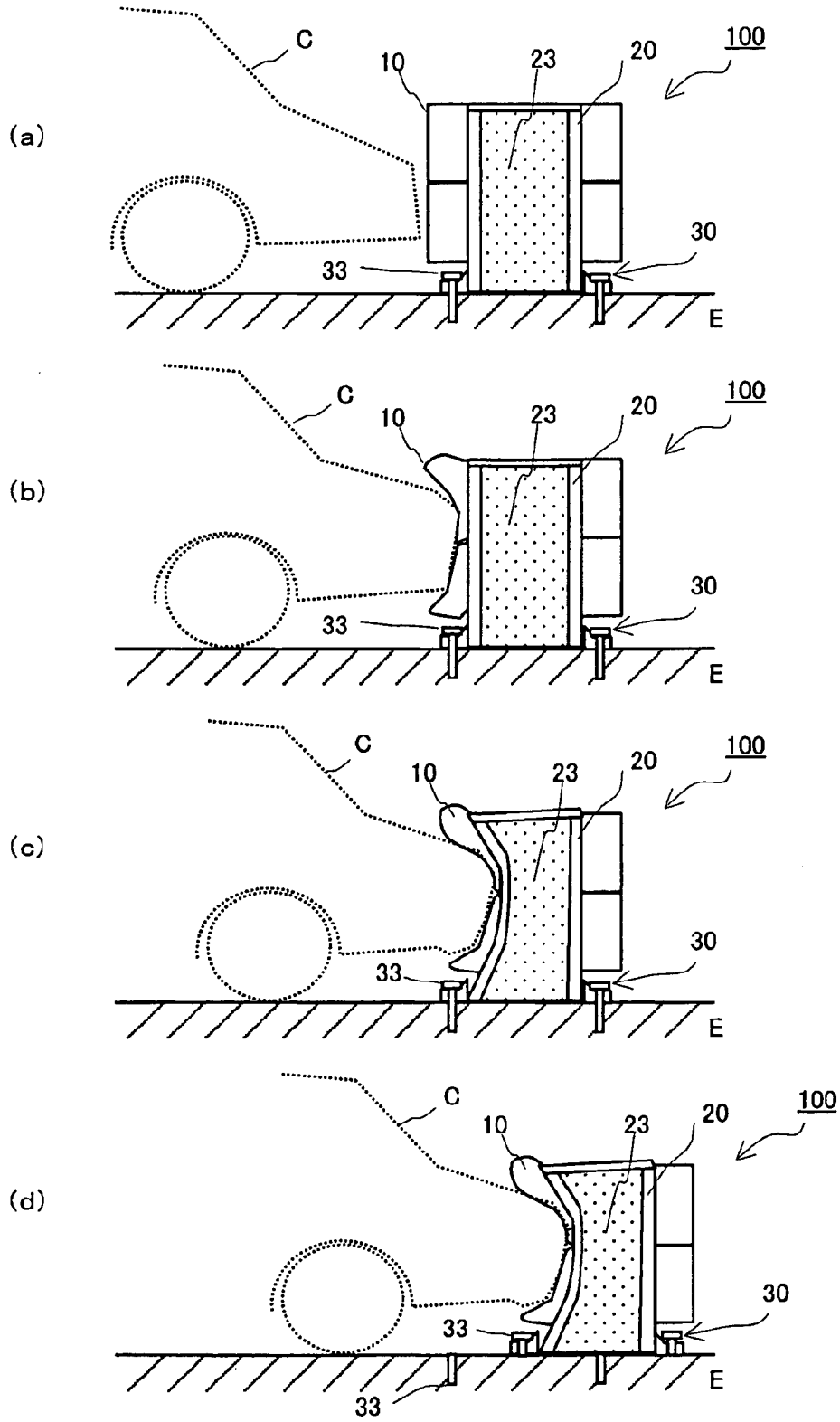
FIG. 2 is a series of longitudinal sectional views illustrating the deformation of the vehicle impact attenuator illustrated in FIG. 1 at the time of a vehicle collision.

FIG. 1 is a perspective view of a vehicle impact attenuator according to a first embodiment of the present invention. FIG. 2(*a*) to (*d*) are longitudinal sectional views illustrating the deformation of the vehicle impact attenuator of FIG. 1 at the time of a vehicle collision.

As illustrated in FIG. 1, the vehicle impact attenuator 100 according to the first embodiment of the present invention comprises a shock absorber 10 that deforms upon a collision by a vehicle to thereby mitigate the impact on the vehicle, a support 20 for the shock absorber 10, and a holding portion 30 that is fixed on an installation surface E and holds the support 20 in a vertical position on the installation surface E. The holding portion 30 comprises a release portion having a breaking strength that allows the release portion to fracture upon application of a load equal to or exceeding a set value and thereby release the support 20. Further, the support 20 has a deformation strength that allows the support to plastically deform upon application of a load less than the set value.

The holding portion 30 comprises a connecting portion 31 fixed on a lower part of the support 20 so as to hold the support 20 in a vertical position, and anchor bolts 33 implanted in the installation surface E through engaging holes 32 provided in the connecting portion 31. The anchor bolts 33 correspond to the release portion, and fracture upon application of a load equal to or exceeding a set value to thereby release the support 20.

Herein, the "installation surface" E, on which the vehicle impact attenuator 100 is installed, is a road surface, the ground near a road, or the upper surface of a base, such as a concrete base, provided on the ground near a road. Further, "release" means making the support 20 incapable of supporting the shock absorber 10 so that the buffering action of the shock absorber is no longer effective, e.g., separating the support 20 from the fixed position on the installation surface E, or collapsing the support 20. These terms are used with the same meanings throughout the specification and claims.

The shock absorber 10 is preferably formed of a plastic cushioning material, such as expandable polystyrene (EPS), expanded polyethylene, expanded polypropylene, expanded polyurethane, or the like. However, other cushioning materials, such as paper cushioning materials, air cushioning materials, etc., are also usable. Although the shock absorber 10 in this embodiment has a doughnut-like shape with a hollow in the middle for inserting the support 20, the shock absorber 10 may have another shape as long as it can be supported by the support 20 at the time of a vehicle collision.

The support 20 is a pipe-like member (e.g., a cylindrical steel pipe), and the plastic deformation occurs as a flattening of the pipe-like support 20. The pipe-like support 20 is made of iron in this embodiment, but it may be made of another metal, a plastic with high bending strength, or another material capable of effectively absorbing the impact of a vehicle collision by plastic deformation.

Further, in the embodiment, the pipe-like support 20 contains an internal cushioning material 23, and sealed with a lid 22 for protection against rain. Various cushioning materials are usable as the internal cushioning material 23, including the above-mentioned plastic cushioning materials, paper cushioning materials, air cushioning materials, etc. The internal cushioning material 23 may be varied in shape and size, from a granular or pebble-sized material to a one-piece cylindrical material to be inserted into the pipe-like support 20. Alternatively, the internal cushioning material 23 may be omitted.

When a vehicle C collides with the vehicle impact attenuator 100 according to the first embodiment of the present invention thus constructed, the impact is first absorbed by the deformation of the shock absorber 10 as shown in FIG. 2(*b*), then by the plastic deformation of the support 20 as shown in FIG. 2(*c*), and then by the fracture of the holding portion 30. When the load exceeds the set value, the anchor bolts 33 of the holding portion 30 fracture to release the support 20 as shown in FIG. 2 (*d*). Therefore, the impact on the vehicle C can be limited to a predetermined value. It is preferable that, after being released, the shock absorber 10 and support 20 be slid, while retaining an approximately vertical position, by a guiding means (not shown), such as casters or guide rails as disclosed in Publications 1 and 2.

Thus, the vehicle impact attenuator 100 of this embodiment can absorb an impact not only by the buffering actions of the shock absorber 10 and holding portion 30, but also by the plastic deformation of the support 20, therefore achieving an impact load absorbing capacity that is higher than that achieved by the flexibility of the shock absorber 10 due to the contribution of the plastic deformation. Because such a structure does not require that the volume of the vehicle impact attenuator 100 be increased, the attenuator 100 has a higher impact load absorbing capacity per installation space than known vehicle impact attenuators. Consequently, the vehicle impact attenuator 100 can be installed in a narrow installation place with limited space, immediately stop the colliding vehicle C, and effectively mitigate the impact on the vehicle C.

In this embodiment, since a pipe-like member, such as a cylindrical steel pipe, is used as the support 20, the plastic deformation to mitigate the impact occurs as a dent in the direction of the collision on the support 20 and then a flattening by expansion of the dent in a direction approximately perpendicular to the direction of the collision. The flattening, in combination with the bending in the vertical direction, flexibly absorbs the impact from the direction of the collision.

Moreover, because the flattening does not depend on the direction of the collision, the buffering action is stabilized. When the shock absorber 10 has a doughnut-like shape and the support 20 is a cylindrical pipe-like member as in this embodiment, the whole body of the attenuator is axially symmetric, and therefore both the shock absorber 10 and support 20 effectively exhibit buffering actions, regardless of the direction of the collision of the vehicle C. Further, the use of a general-purpose product as the pipe-like support 20 reduces the cost.

Since this embodiment uses the internal cushioning material 23, which contributes to the absorption of the impact at the time of flattening of the pipe-like support 20, the impact absorbing capacity of the pipe-like support 20 can be easily optimized by selecting the presence or absence, and the form and quality of the internal cushioning material 23. This makes it possible to easily realize the vehicle impact attenuator 100 with an impact absorbing capacity suitable for the conditions of the installation site.

Moreover, the use of anchor bolts 33 makes it easy to realize a release portion that fractures upon application of a load equal to or exceeding a set value to thereby release the support 20.

The set value for the fracture of the release portion (anchor bolts 33), the yield point load that flattens the pipe-like support 20, the quality, outer diameter and wall thickness of the pipe-like support 20, the presence or absence and type of the internal cushioning material 23 can be optimally selected according to the conditions of the installation site.

On ordinary installation sites, i.e., road surfaces or roadsides, the weight of a colliding vehicle can be assumed to be 0.5 to 3 t, and the acceleration generated by the collision to be 100 to 300 $m/s^2$. In this case, it is preferable that, with respect to the support 20, the set value for the fracture of the release portion (anchor bolts 33) be 50 to 900 kN, and the yield point load that flattens the pipe-like support 20 be 25 to 800 kN. More preferably, the set value is 80 to 400 kN and the yield point load is 50 to 350 kN, and even more preferably, the set value is 120 to 250 kN, and the yield point load is 100 to 200 kN. By adjusting the set value and yield point load within the above ranges, the above-mentioned effects can be accomplished to a remarkable extent.

The pipe-like support 20 is preferably made of iron or plastic and preferably has an outer diameter of 100 to 800 mm and a wall thickness of 0.8 to 100 mm. More preferably, the outer diameter is 130 to 500 mm and the wall thickness is 1.0 to 20 mm, and even more preferably, the outer diameter is 200 to 320 mm and the wall thickness is 1.6 to 6 mm. This makes it possible to adjust the yield point load of the pipe-like support 20 within the above range.

In particular, when using a plastic, such as a glass fiber reinforced phenolic resin or like plastic with high bending strength, the pipe-like support 20 preferably has an outer diameter of 100 to 800 mm and a wall thickness of 1.6 to 100 mm, more preferably an outer diameter of 130 to 400 mm and a wall thickness of 1.6 to 40 mm, and even more preferably an outer diameter of 200 to 350 mm and a wall thickness of 3 to 12 mm.

Second Embodiment

Figure 3:
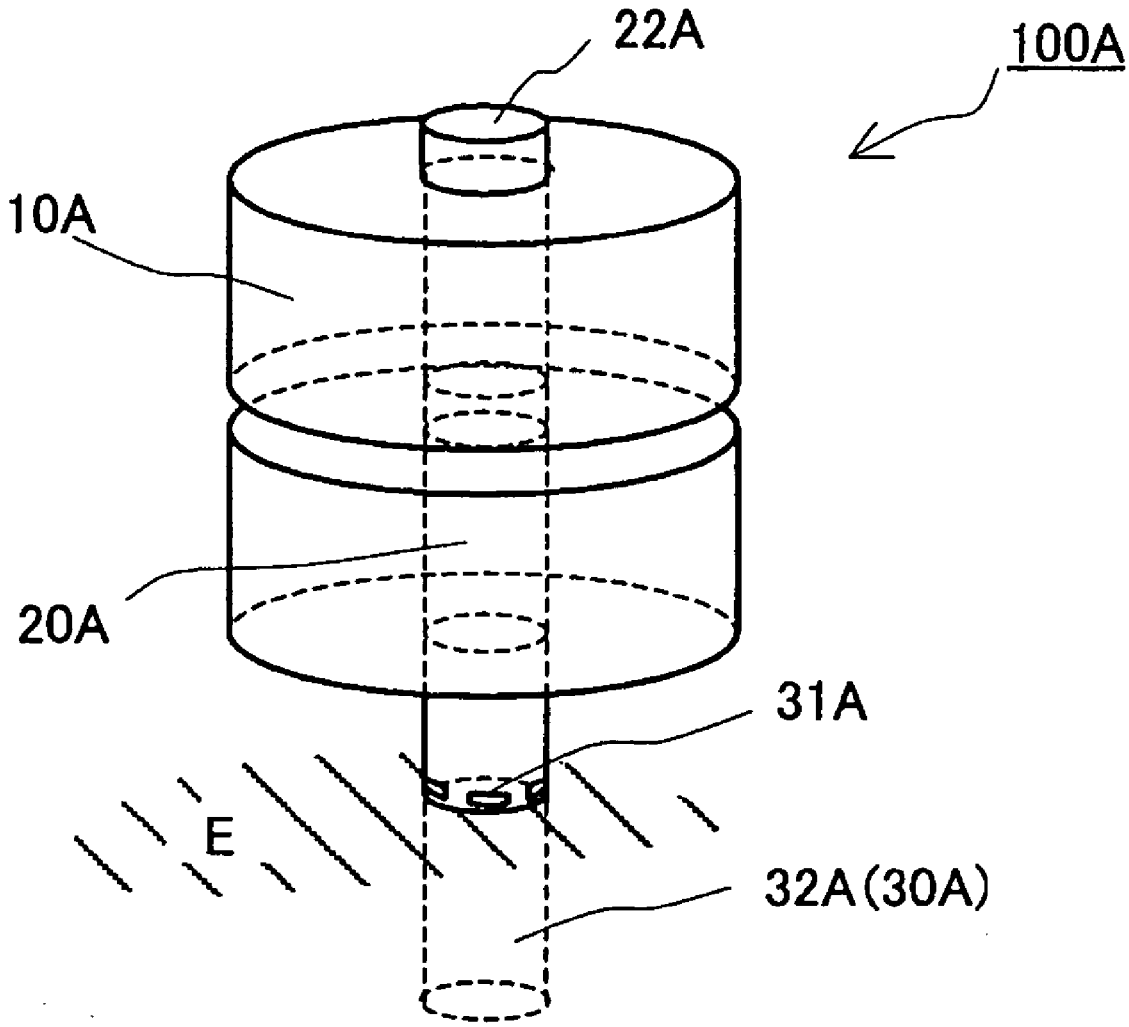
FIG. 3 is a perspective view illustrating a vehicle impact attenuator according to a second embodiment of the present invention.
Figure 4:
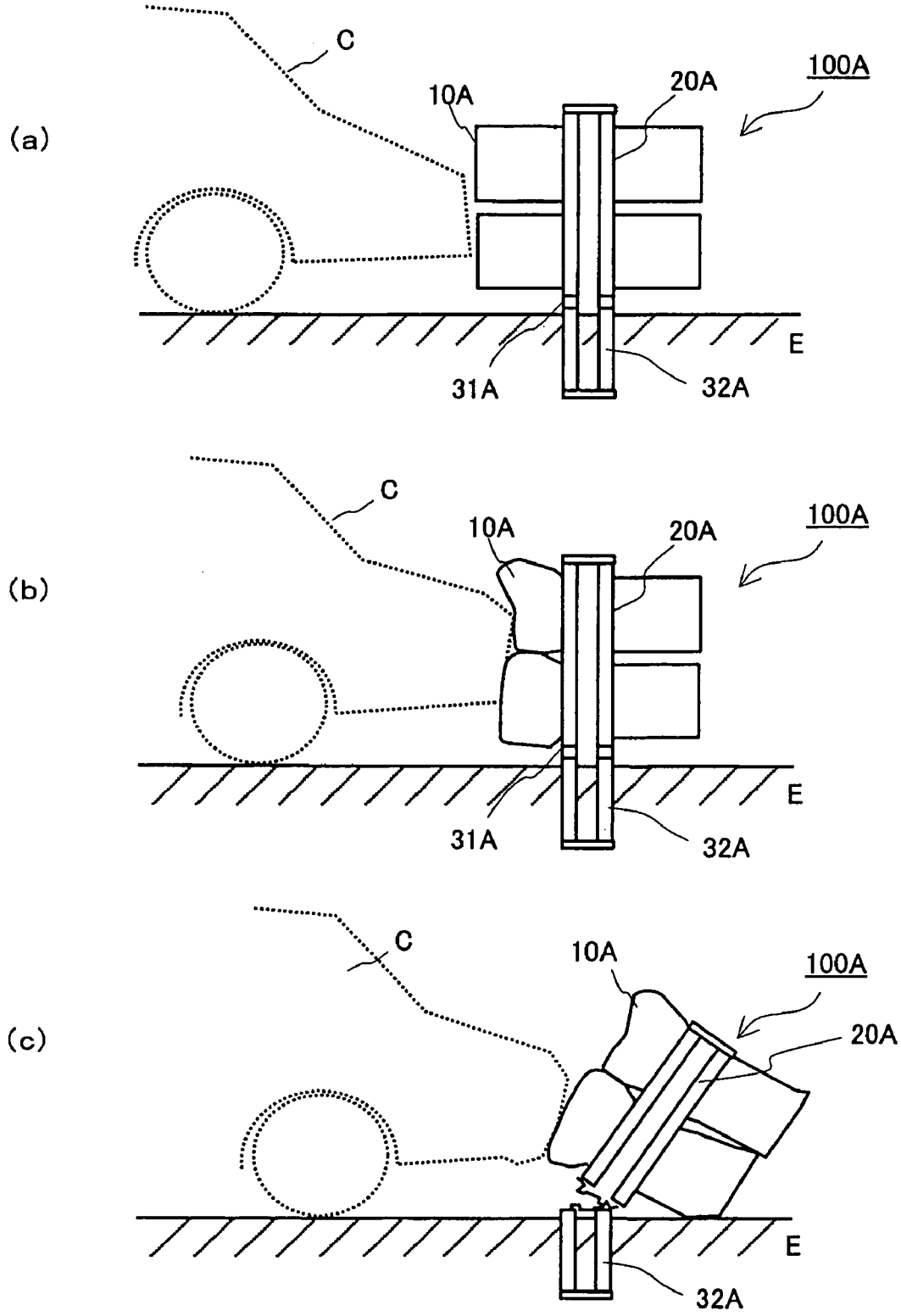
FIG. 4 is a series of longitudinal sectional views illustrating the deformation of the vehicle impact attenuator illustrated in FIG. 3 at the time of a vehicle collision.

FIG. 3 is a perspective view of a vehicle impact attenuator according to a second embodiment of the present invention. FIG. 4 is a series of longitudinal sectional views illustrating the deformation of the vehicle impact attenuator illustrated in FIG. 3 at the time of a vehicle collision.

As shown in the figures, the vehicle impact attenuator 100A according to the second embodiment of the present invention comprises a shock absorber 10A that deforms upon a collision by a vehicle to thereby mitigate the impact on the vehicle, and a support 20A for the shock absorber 10A. Like in the first embodiment, the support 20A is a pipe-like member (e.g., a cylindrical steel pipe). A continuing portion 32A formed as a lower part of the support 20A is buried in a region below the installation surface E (hereafter the installation surface E and the region below it are collectively referred to as the "installation area"), whereby the support 20A is held vertically to the installation surface E. The support 20A has cuts 31A in a part that is slightly above the installation surface E. The cuts 31A penetrate the support 20A, and have elongated openings along a plane approximately perpendicular to the major axis of the support 20A. The continuing portion 32 and burying hole formed in the installation area constitute the holding portion 30A.

The cuts 31A of the support 20A form a release portion that serves as starting points for a fracture due to a load equal to or exceeding a set value. Namely, the breaking strength of parts adjacent to the cuts 31A of the support 20A is set so that the parts are fractured by a load equal to or exceeding a set value to thereby release the support 20A. However, the support 20A is not designed to plastically deform as in the first embodiment. Specifically, the set value for the fracture of the parts adjacent to the cuts 31A is lower than the yield point load that flattens the pipe-like support 20A.

The shock absorber 10A is the same as the shock absorber in the first embodiment and thus the explanation thereof is omitted.

When a vehicle C collides with the vehicle impact attenuator 100A of this embodiment thus constructed, the shock absorber 10A deforms to absorb the impact as illustrated in FIG. 4(*b*). When the load equals to or exceeds the set value, the cuts 31A serve as starting points to fracture the parts adjacent thereto, thereby releasing the support 20A. Accordingly, the impact on the vehicle C can be limited to a predetermined value.

The vehicle impact attenuator 100A of this embodiment has a simple structure comprising a plain one-piece pipe-like member as the support 20A, the pipe-like member having cuts 31A in its lower part. Such a structure enables manufacturing the vehicle impact attenuator 100A by a small number of steps and at low cost.

Further, the support 20A can be installed by burying its lower part (the continuing portion 32A) in a burying hole provided in the installation area, in such a manner that the cuts 31A are disposed above the installation surface E. This simplifies and facilitates the installation, reduces the installation cost, and decreases the necessary installation space.

Third Embodiment

Figure 5:
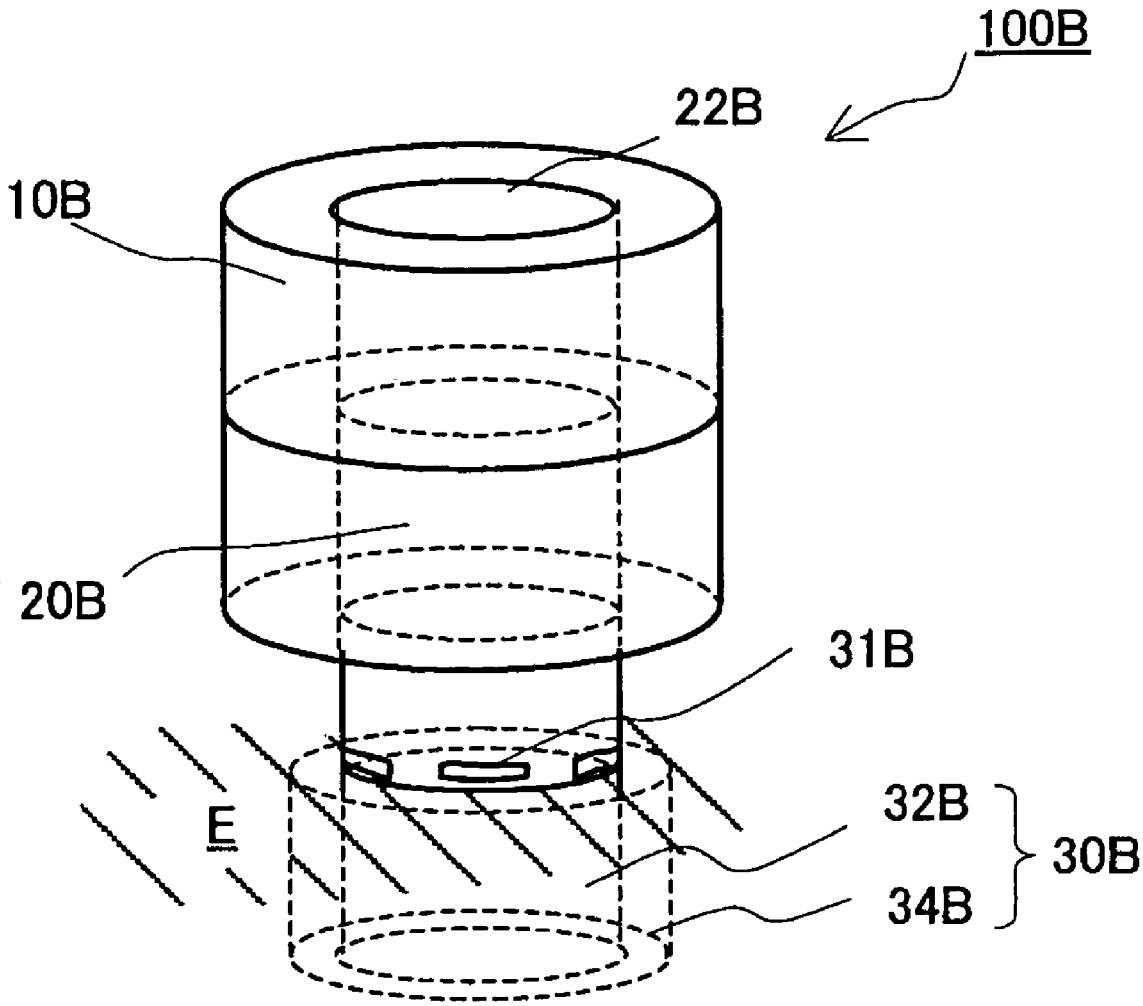
FIG. 5 is a perspective view illustrating a vehicle impact attenuator according to a third embodiment of the present invention.
Figure 6:
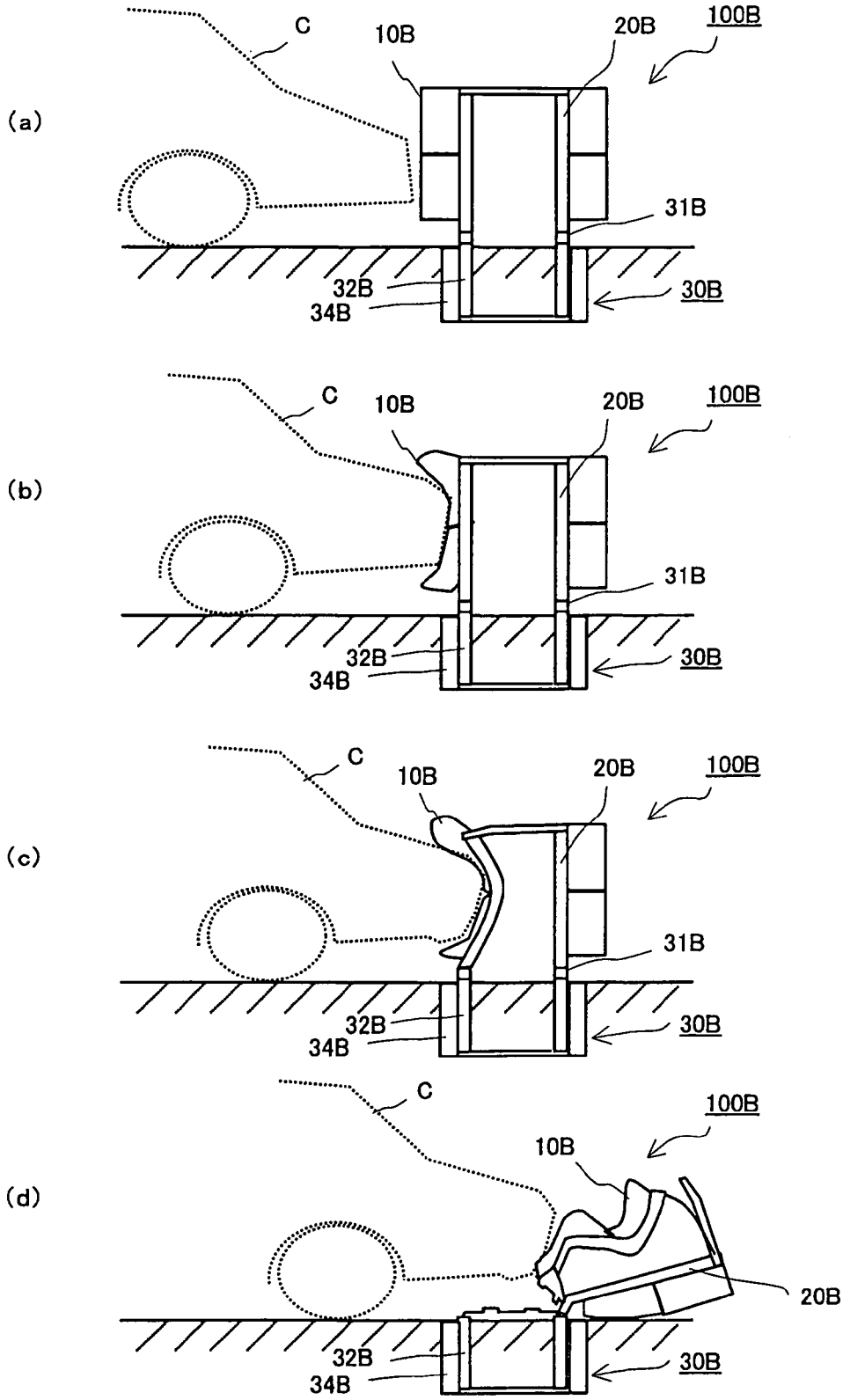
FIG. 6 is a series of longitudinal sectional views illustrating the deformation of the vehicle impact attenuator illustrated in FIG. 5 at the time of a vehicle collision.

FIG. 5 is a perspective view illustrating a vehicle impact attenuator according to a third embodiment of the present invention. FIG. 6 is a series of longitudinal sectional views illustrating the deformation of the vehicle impact attenuator illustrated in FIG. 5 at the time of a vehicle collision.

As shown in the figures, the vehicle impact attenuator 100B according to the third embodiment of the present invention comprises a shock absorber 10B that deforms upon a collision by a vehicle to thereby mitigate the impact on the vehicle, a support 20B for the shock absorber 10B, and a holding portion 30B that is fixed on an installation surface E to hold the support 20B vertically to the installation surface E. The holding portion 30B comprises a continuing portion 32B formed as a lower part of the support 20B, and a fitting member 34B buried below the installation surface E to engage and hold the continuing portion 32B, whereby the support 20B is held in a vertical position. Like in the second embodiment, the support 20B has, as a release portion, in a part slightly above the installation surface E, cuts 31B with elongated openings that serve as starting points for a fracture due to a load equal to or exceeding a set value. Namely, the breaking strength of parts adjacent to the cuts 31B of the support 20B is set so that the region is fractured by a load equal to or exceeding the set value to thereby release the support 20B. Furthermore, like in the first embodiment, the deformation strength of the support 20B is established so as to allow the support 20B to plastically deform upon application of a load less than the set value.

The shock absorber 10B is the same as the shock absorber in the first embodiment, and thus the explanation thereof is omitted.

Like in the first embodiment, the support 20B is a pipe-like member (e.g., a cylindrical steel pipe), and the plastic deformation occurs as a flattening of the pipe-like support 20B.

Further, in this embodiment, the fitting member 34B is sufficiently strong to approximately retain its original shape even after the support 20B fractures at the parts adjacent to the cuts 31B. Such a fitting member 34B preferably has a yield point load of 80 to 1500 kN. When the fitting member 34B has a cylindrical shape that is capable of accommodating the continuing portion 32B as in this embodiment, it is preferable that the fitting member 34B be made of metal, such as iron, and have an inner diameter slightly larger than the outer diameter of the continuing portion 32B, with a clearance of 0 to 30 mm, and a wall thickness of 3 to 80 mm.

When a vehicle C collides with the vehicle impact attenuator 100B according to the third embodiment of the present invention thus constructed, the impact is first absorbed by the deformation of the shock absorber 10B as shown in FIG. 6(*b*), then by the plastic deformation of the support 20B as shown in FIG. 6(*c*), and then by the fracture of the parts adjacent to the cuts 31B. When a load equals to or exceeding the set value is applied, the cuts 31B serve as starting points for the fracture of the parts adjacent to the cuts 31B to thereby release the support 20B. Therefore, the impact on the vehicle C can be limited to a predetermined value.

Thus, the vehicle impact attenuator 100B according to this embodiment, like the attenuator of the first embodiment, has a high impact load absorbing capacity because of the contribution of the plastic deformation of the support 20B, increasing the impact load absorbing capacity per installation space.

Further, like in the second embodiment, the vehicle impact attenuator 100B of this embodiment has a simple structure comprising a plain one-piece pipe-like member as the support 20B, the pipe-like member having cuts 31B in its lower part, and therefore can be produced and installed at low cost. Furthermore, the attenuator can be installed in a narrow place with limited space, immediately stop a colliding vehicle C, and mitigate the impact on the vehicle C.

Moreover, since the attenuator of this embodiment comprises a fitting member 34B, even when a load equal to or exceeding the set value is applied at the time of a vehicle collision, the impact is concentrated in the region with the cuts 31B, which is less strong than the fitting member 34B. This allows the region with the cuts 31B to smoothly fracture and effectively prevents damage to the fitting member 34B.

After a collision, the base portion (fitting member 34B) of the vehicle impact attenuator 100B can be made usable by simply removing the remains (the continuing portion 32B that forms a lower part of the support 20B and other portions) inside or around the fitting member 34B. Thus, the attenuator can be withdrawn and renewed very easily, reducing the cost and time necessary for installation and restoration.

Figure 7:
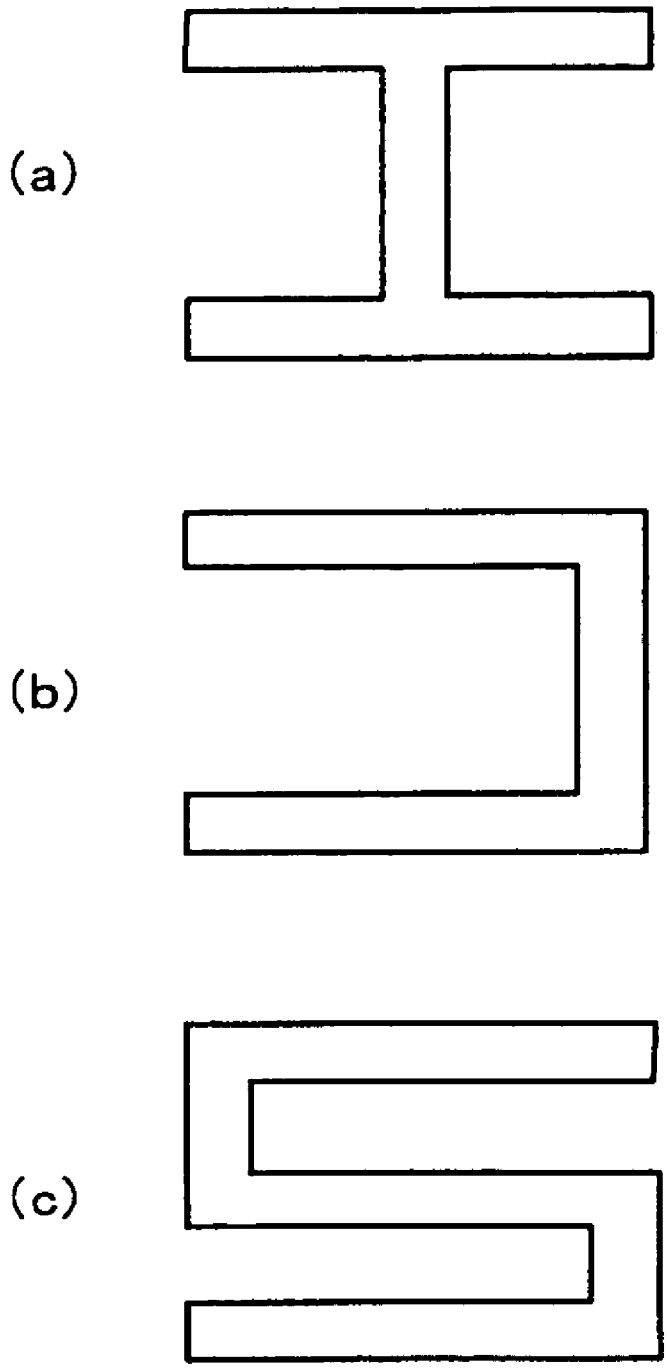
FIG. 7 is a series of cross sectional views illustrating example of the support.

In the first to third embodiments described above, the supports 20, 20A and 20B are pipe-like (e.g., cylindrical) members, but the support may have any of various shapes other than a pipe-like shape. For example, the support may be a rod-like member with an H-, U- or S-shaped cross section as shown in FIG. 7(*a*) to (*c*). It is preferable, however, that the support be a pipe-like member capable of being held by the holding portion 30, 30A or 30B in a vertical position to support the shock absorber 10, 10A or 10B, which generally receives an impact in an approximately horizontal direction.

In the second and third embodiments, cuts 31A or 31B are formed in the support 20A or 20B at a part slightly higher than the installation surface E, in the shape of elongated through-holes that penetrate the support 20A or 20B and are disposed along a plane approximately perpendicular to the major axis of the support 20A or 20B. However, the cuts 31A and 31B may have other shapes, and need not be through-holes.

Figure 8:
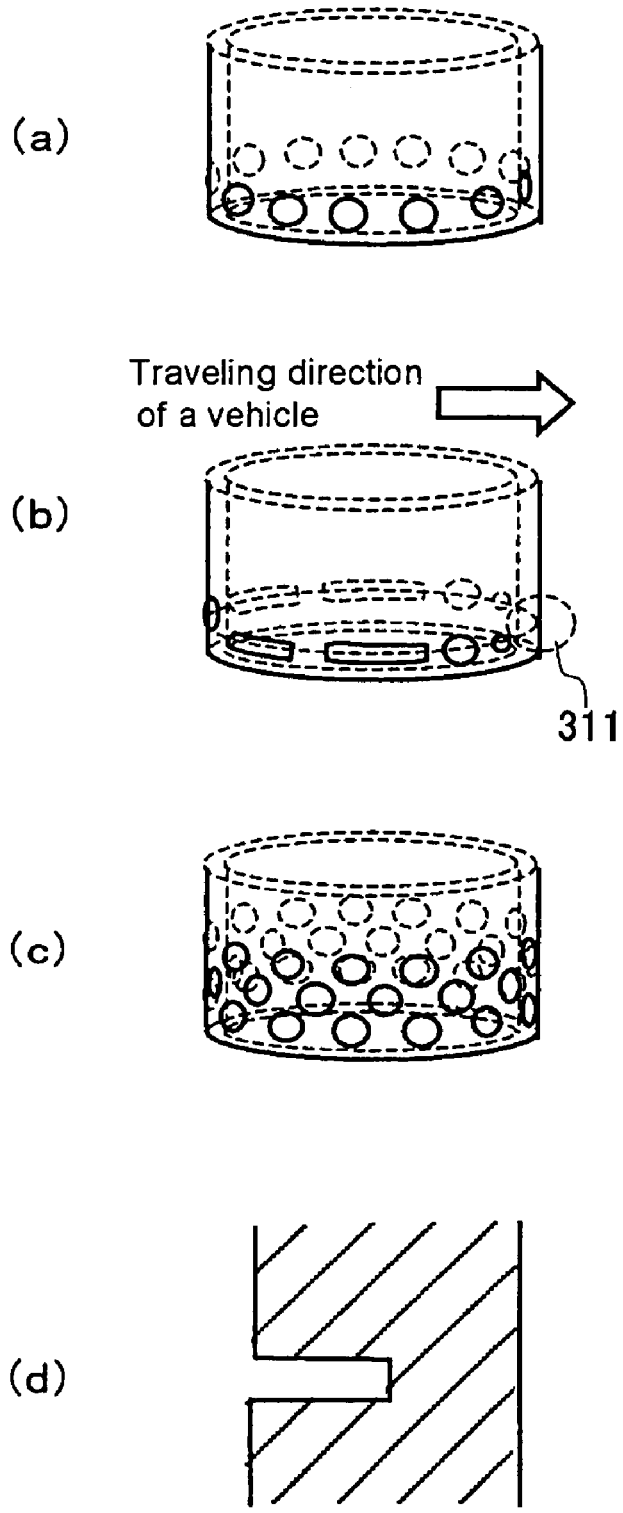
FIG. 8 shows drawings of a part of the support. (a) to (c) are perspective views illustrating regions with cuts, and (d) is a longitudinal sectional view of a region with a notch.

For example, cuts with various shapes as shown in FIG. 8(*a*) to (*c*) may be provided to the continuing portion. In FIG. 8(*a*) and (*b*), a plurality of circular or elongated rectangular holes are provided approximately in a line along an approximately circumferential direction. In FIG. 8(*c*), a plurality of circular holes are disposed so as to form a plurality of lines.

As shown in FIG. 8(*d*) (a partial longitudinal sectional view of the support), the support may be provided with a cut (or a notch) that does not penetrate the support and is formed along a plane approximately perpendicular to the major axis of the support. Such a cut may be formed on a solid member as well as a hollow member such as a pipe.

Since the yield point load of the parts adjacent to the cuts in the support varies with the shape and other features of the cuts, the breaking strength of the parts adjacent to the cuts can be easily adjusted to a desired value by designing the cuts (size, shape, number, arrangement) according to the wall thickness and strength of the support. Therefore, a vehicle impact attenuator can be easily realized which has a breaking strength suitable for the conditions of the installation site.

Further, the form of the cuts can be selected depending on whether a single attenuator or a set of two or more attenuators is used. When using a single vehicle impact attenuator, it is preferable that, at the time of the fracture of the region with cuts, the support be pulled downward with the bottom of the support still fastened to the installation surface to some degree, in order to stop the support from scattering and thus prevent secondary accidents. For that purpose, the continuing portion is preferably provided with a fastening portion 311 on a part of its periphery as shown in FIG. 8(*b*). By installing the vehicle impact attenuator so that the fastening portion 311 is positioned on the back side of the support as seen from the colliding vehicle, the support remains fastened to the installation surface to some degree by the fastening portion on its back side, even when the region with cuts is fractured due to a collision.

When using a set of two or more vehicle impact attenuators, the attenuator installed in the front part of the set is preferably made so that the support, at the time of the fracture of the region with cuts, be separated from the installation surface and slide while retaining an approximately vertical position. Holes that facilitate separation of the support can be easily realized by increasing the area occupied by the cuts (e.g., increasing the number of the cuts or enlarging the openings of the cuts), by reducing the spaces between adjacent cuts, or by increasing the depth of the notch shown in FIG. 8(*d*). This makes it possible to continuously retain, after the fracture of the region with cuts, the impact absorbing effect of the shock absorber and the support of the subsequent vehicle impact attenuator. Preferably, scattering of the support is prevented by a suitable guiding means, rope or the like. In the vehicle impact attenuator installed in the back part of the set, the support is preferably pulled downward while the bottom of the support remains fastened to the installation surface.

In the third embodiment, a cylindrical fitting member is used, but the fitting member may have any shape as long as it fits on the continuing portion to hold the support in a vertical position and approximately retain original shape after the fracture of the release portion (cuts).

Figure 9:
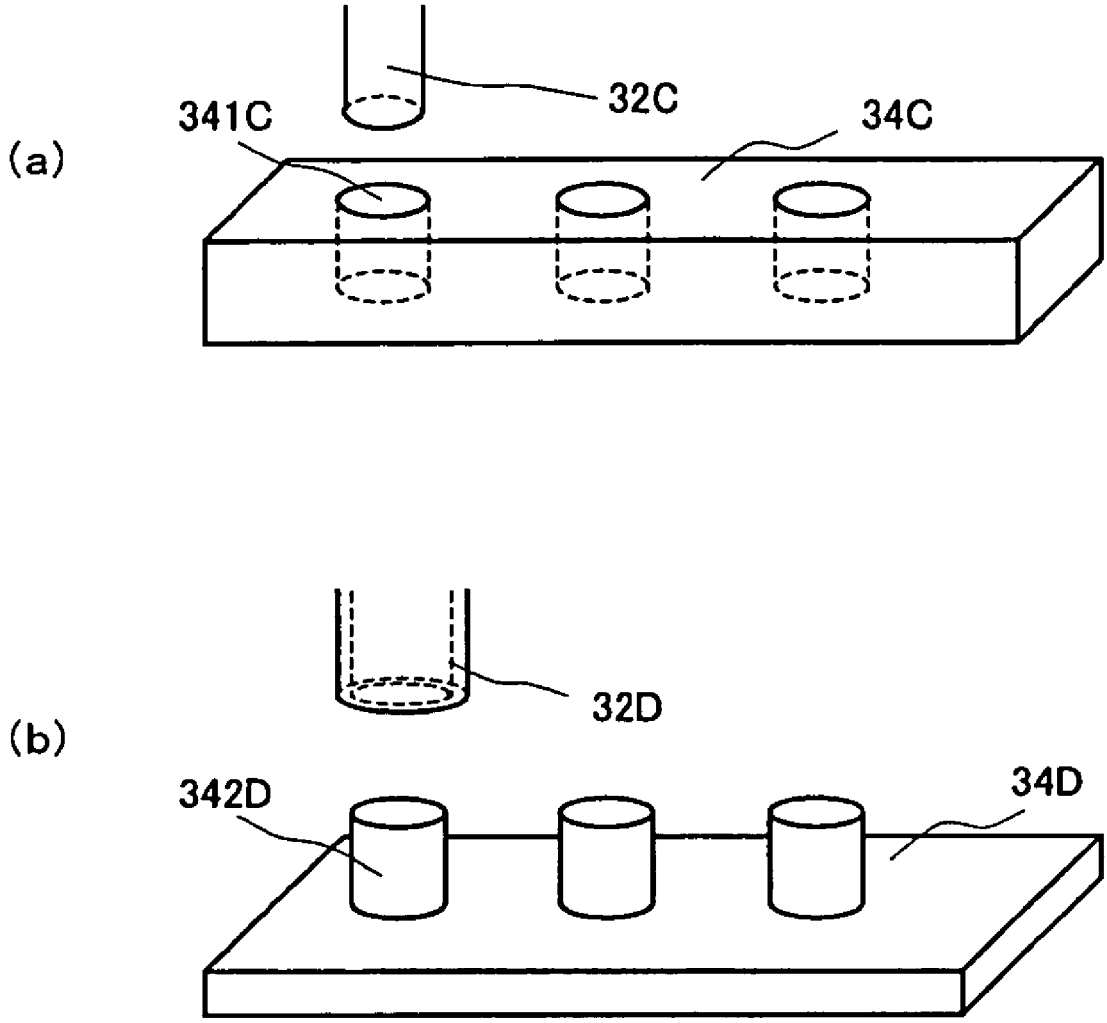
FIG. 9 is a pair of longitudinal sectional views illustrating examples of the fitting member.

FIG. 9(*a*) and (*b*) are longitudinal sectional views illustrating other examples of the fitting member and continuing portion.

The fitting member 34C shown in FIG. 9(*a*) is a floorboard-like member to be buried below the installation surface. The upper surface of the floorboard-like member is provided with insertion openings 341C to which the continuing portion 32C is inserted, to thereby hold the support in a vertical position. In the fitting member 34D shown in FIG. 9(*b*), the upper surface of the floorboard-like member is provided with projections each of which is inserted into the continuing portion 32D, to thereby hold the support in a vertical position. In the structure shown in (*b*), the cuts of the support are formed at a part slightly higher than the top end of the projections 342D.

In the first to third embodiments, the vehicle impact attenuator is installed singly. However, in places where a vehicle is likely to collide at a high speed, it is often suitable to install a plurality of the vehicle impact attenuators side by side. In such a case, the use of the fitting member 34C or 34D that has two or more insertion openings 341C or projections 342D eliminates the necessity of determining the distance between the vehicle impact attenuators at the installation site, facilitating the installation operation.

Figure 10:
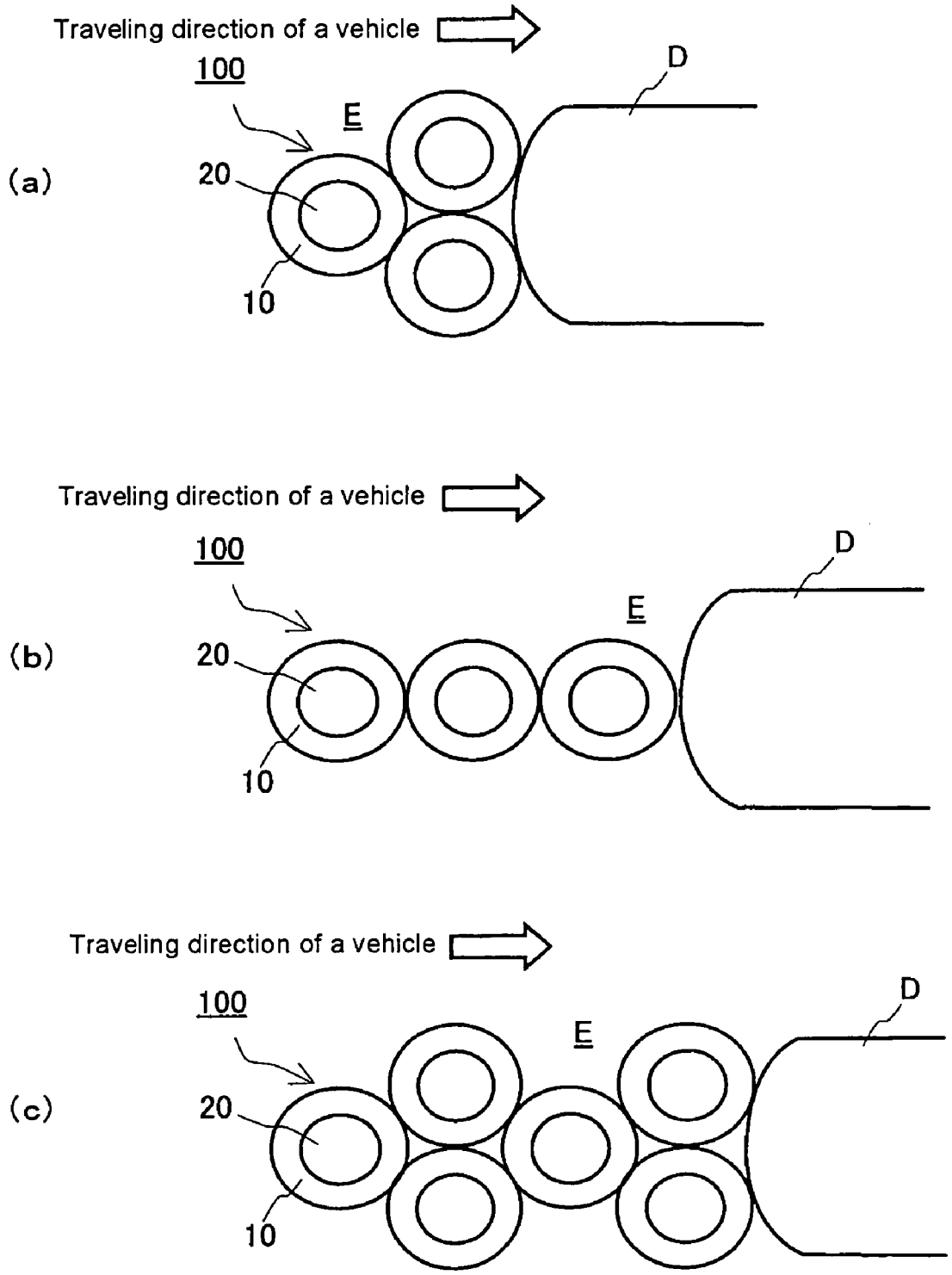
FIG. 10 is a plan view illustrating an example of an arrangement of a plurality of vehicle impact attenuators according to the first embodiment of the present invention.

FIG. 10(*a*) to (*c*) are plan views illustrating examples of arrangements of a plurality of vehicle impact attenuators according to the first embodiment of the present invention. As shown in the figure, vehicle impact attenuators 100 are installed on an installation surface E at a median strip end D.

In such arrangements, it is preferable that the vehicle impact attenuators 100 be adjoined so that the shock absorbers are in contact with each other, and arranged along the expected direction of the collision, i.e., the traveling direction of vehicles that may collide with the attenuators. This makes it possible for the subsequent vehicle impact attenuator 100 to immediately absorb the impact, and thereby stop the colliding vehicle within a short distance and effectively mitigate the impact on the vehicle, even when the impact applied to one of the vehicle impact attenuators 100 reaches the yield point and releases the support 20.

At a median strip end D as shown in FIG. 10, vehicle impact attenuators need to be installed generally within a narrow width of about 40 to 100 cm, and therefore it is difficult to install known impact attenuators. However, the vehicle impact attenuator 100 according to the first embodiment of the present invention has an increased impact load absorbing capacity per installation space, and can be installed in a narrow place, such as the median strip end D, while retaining sufficient ability to stop vehicles and mitigate impacts. In some cases, the number of the vehicle impact attenuators 100 to be installed side by side can be decreased, thus greatly reducing the necessary installation space.

The installation of the vehicle impact attenuators at a median strip end is explained above, but the vehicle impact attenuators are also applicable to various other places where vehicle collisions are liable to occur, such as road forks, the ends of branch points for tollgates, etc.

Figure 11:
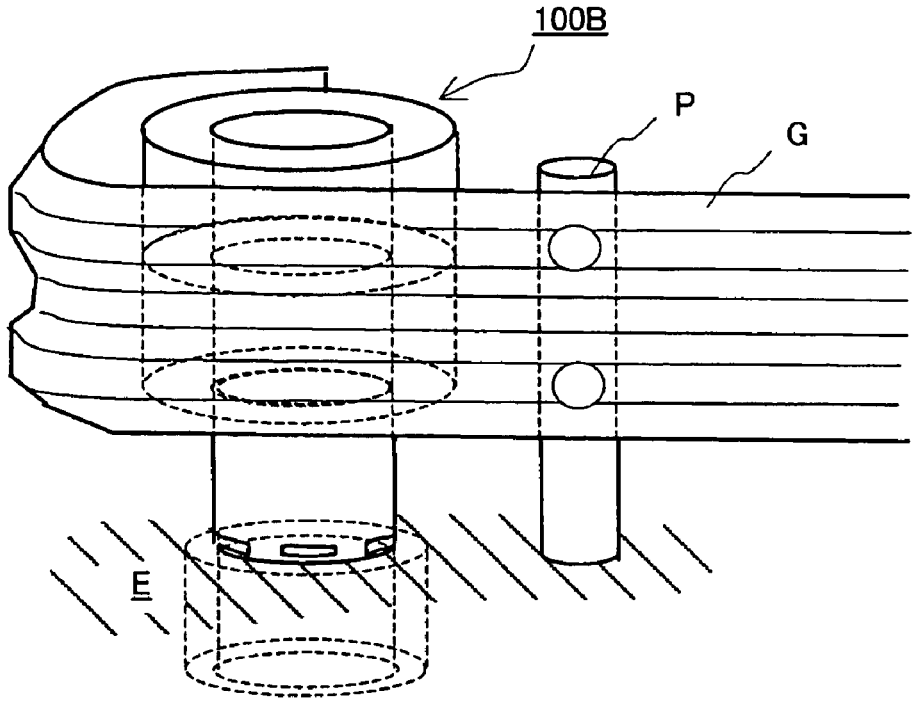
FIG. 11 shows a perspective view (a) and plan view (b) illustrating a vehicle impact attenuator according to the third embodiment of the present invention installed behind an end portion of a guardrail supported by a plurality of poles.
Figure 11:
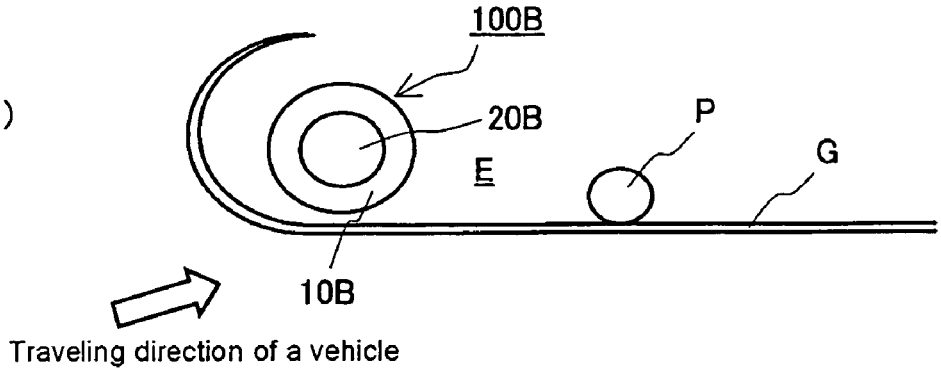

FIG. 11(*a*) is a perspective view showing a vehicle impact attenuator according to the third embodiment of the present invention installed behind an end portion of a guardrail G supported by a plurality of poles P. FIG. 11 is a plan view of the vehicle impact attenuator and guardrail. As shown in the figure, the vehicle impact attenuator 100B is installed on the installation surface E behind the end portion of the guardrail.

The guardrail G is firmly constructed usually of steel to prevent vehicles from entering the area protected thereby. However, the end portion past the pole P supporting the guardrail G will sharply bend when a vehicle collides with it, and thus cannot sufficiently prevent vehicles from entering, exposing the protected area to danger.

The vehicle impact attenuator 100B can be installed in a narrow installation place with limited space as mentioned above and shown in the figure. The vehicle impact attenuator 100B installed on the installation surface E behind an end portion of a guardrail can immediately stop a colliding vehicle and effectively mitigate the impact on the vehicle.

Fourth Embodiment

Figure 12:
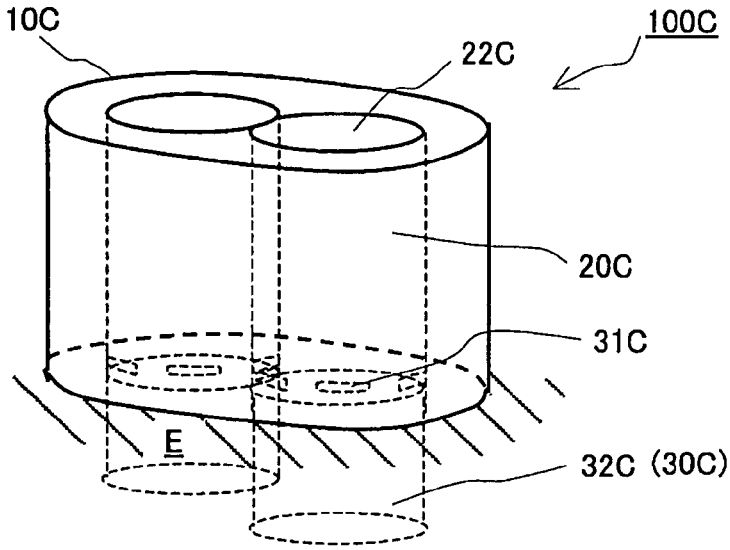
FIG. 12 is a perspective view illustrating a vehicle impact attenuator according to a fourth embodiment of the present invention.
Figure 13:
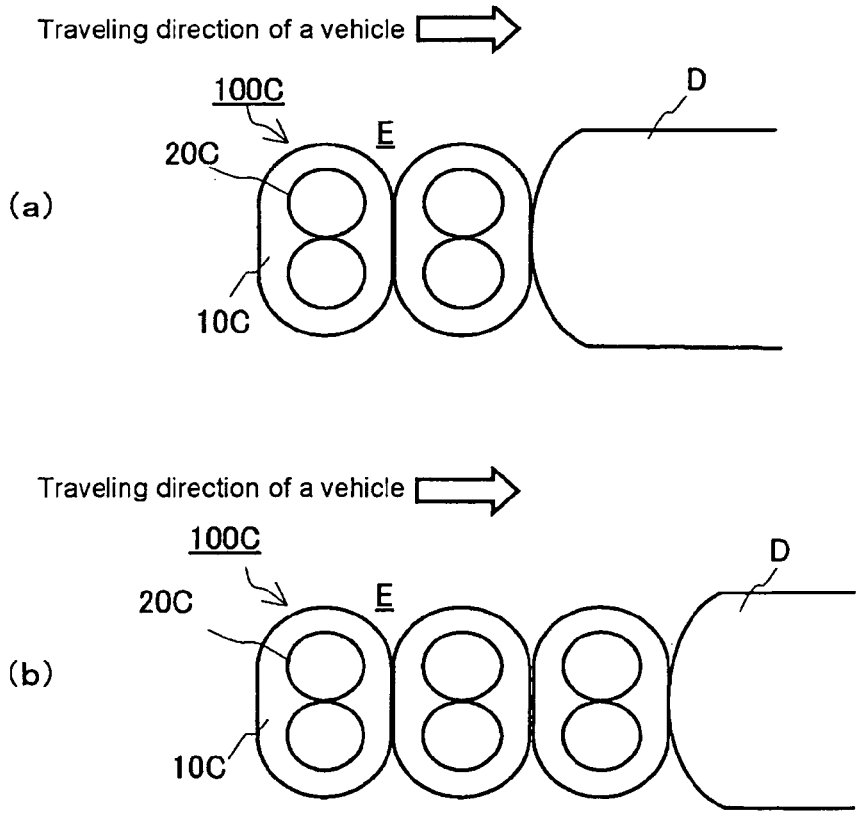
FIG. 13 is a plan view illustrating an example of an arrangement of a plurality of the vehicle impact attenuator illustrated in FIG. 12.

FIG. 12 is a perspective view of a vehicle impact attenuator according to a fourth embodiment of the present invention. FIG. 13(*a*) and (*b*) are plan views showing examples of arrangements of a plurality of the vehicle impact attenuator shown in FIG. 12. It can be construed that this vehicle impact attenuator comprises a pipe-like support having a figure-of-8-shaped cross section (see FIG. 7).

As illustrated in FIG. 12, the vehicle impact attenuator 100C according to the fourth embodiment of the present invention comprises a shock absorber 10C that deforms upon a collision by a vehicle to thereby mitigate the impact on the vehicle, two supports 20C for the shock absorber 10C, and holding portions 30C that are fixed below an installation surface E to hold the two supports 20C vertically to the installation surface E. The supports 20C and holding portions 30C have the same structures as the support 20A or 20B and the holding portion 30A or 30B of the vehicle impact attenuator 100A or 100B according to the second or third embodiment.

Unlike the vehicle impact attenuators 100A and 100B according to the second and third embodiments, the vehicle impact attenuator 100C comprises two supports 20C each having cuts 31C and continuing portion 32C, two holding portions 30C, and a shock absorber 10C that is an approximately elliptical cylinder surrounding the two pipe-like supports 20C, the shock absorber 10C being in direct contact with the installation surface E. The vehicle impact attenuator 100C is the same as the vehicle impact attenuator 100B according to the third embodiment of the present invention except for the above points. Thus, the explanation of the vehicle impact attenuator 100C is omitted. With respect to the set value for the fracture of the cuts 31 and the yield point load that flattens the pipe-like supports 20C, it is preferable that the total set value and total yield point load of the two supports 30C be within the ranges specified in the explanation of the first embodiment.

Like the third embodiment, the vehicle impact attenuator 100C according to this embodiment has an increased impact load absorbing capacity due to the contribution of the plastic deformation of the supports 20C, thereby achieving a high impact load absorbing capacity per installation space. In particular, the vehicle impact attenuator of this embodiment comprises two adjacent pipe-like supports 20C, whose plastic deformation greatly contributes to a higher impact load absorbing capacity. Furthermore, the supports 20C dissipate the impact on a colliding vehicle.

When a plurality of such vehicle impact attenuators are installed in a row, it is preferable to dispose two or more vehicle impact attenuators 100C in the direction perpendicular to the direction of the row of the two pipe-like supports 20C, as shown in FIG. 13(*a*) and (*b*). Moreover, as mentioned above, the design of the cuts and the type of internal cushioning material can be selected to vary the vehicle impact attenuators with respect to the set value for the fracture of the supports 20C or the yield point load that flattens the supports 20C, according to the order in the row. For example, it is preferable that, in the vehicle impact attenuator 100C in the front of the row, a plurality of cuts be provided in a line along an approximately circumferential direction as mentioned above, to thereby facilitate the fracture. In the vehicle impact attenuator 100C in the back of the row, it is preferable that the fastening portion mentioned above be provided on a part of the support 20C and allow the support 20C to remain fastened to the installation surface even when the cuts are fractured.

EXAMPLE 1

With respect to vehicle impact attenuators according to the first, third or fourth embodiment, which absorb an impact load by the flattening of the pipe-like member, the preferable ranges of the outer diameter and wall thickness of the pipe-like support were studied, assuming that the weight of the colliding vehicle is 1 t, the acceleration generated by the collision is 100 to 300 m/s$^2$, and the position at which the vehicle struck is 50 cm high from the ground. The outer diameters were selected according to JIS G3444. The pipe-like supports used were made of cast iron and had a breaking stress of 400 MPa. In addition to vehicle impact attenuators comprising one pipe-like member as in the first or third embodiment, vehicle impact attenuators comprising two pipe-like supports as in the fourth embodiment, and vehicle impact attenuators comprising three pipe-like supports were used. Table 1 shows the results.

In the table, "bending" and "flattening" indicate the loads absorbed by the bending and flattening of the pipe-like member, respectively. From the above assumption, the total of the loads needs to be 100 to 300 kN or more. Further, "I.C.: internal cushioning material" in the "adjustment" column indicates that the use of an internal cushioning material in the pipe-like member is preferable.

Figure 14:
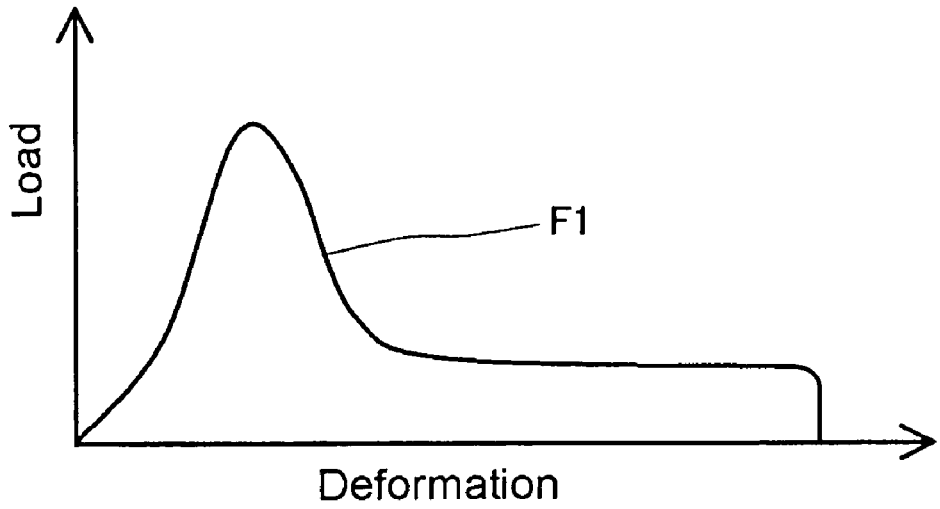
FIG. 14 shows graphs schematically showing the relation between the displacement and load of a pressure-applying end pressed against the pipe-like member. (a) shows the relation in the case where the pipe-like member contains no internal cushioning material, and (b) shows the relation in the case where the pipe-like member contains an internal cushioning material.
Figure 14:
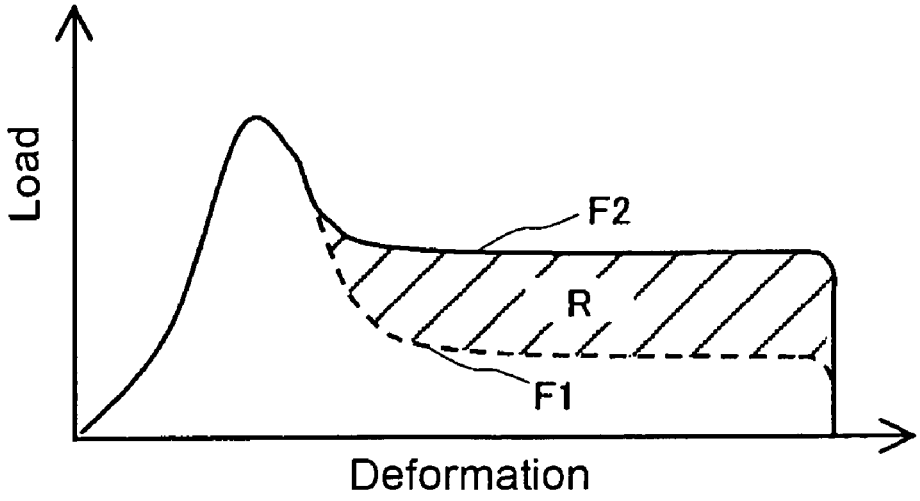

The pressure-applying end of a pressure device was pressed to the center of the pipe-like member(s), which was 50 cm from each of the fixed ends, to measure the displacement and load of the pressure-applying end. FIG. 14(*a*) and (*b*) are graphs schematically showing the relationships between the displacement and load of support(s) containing an internal cushioning material and support(s) without an internal cushioning material, respectively. FIG. 14(*b*) reveals that the use of an internal cushioning material achieved the impact load absorbing capacity indicated by Curve F2, which is greater than the impact load absorbing capacity indicated by Curve F1, by the amount shown by Area R.

TABLE 1

| Outer diameter | Number of supports | Thickness | Bending | Flattening | Adjustment |
|---|---|---|---|---|---|
| 216.3 mm | 1 | 3.5 mm | 100 kN | 20 kN | I.C. |
| | | 7.5 mm | 200 kN | 95 kN | I.C. |
| | | 12 mm | 300 kN | 250 kN | Unnecessary |
| | 2 | 1.7 mm | 50 kN | 4.5 kN | I.C. |
| | | 3.5 mm | 100 kN | 20 kN | I.C. |
| | | 6.0 mm | 150 kN | 60 kN | I.C. |
| 318.5 mm | 1 | 1.6 mm | 100 kN | 2.7 kN | I.C. |
| | | 3.2 mm | 200 kN | 11 kN | I.C. |
| | | 5 mm | 300 kN | 27 kN | I.C. |
| | 2 | 0.8 mm | 50 kN | 0.7 kN | Impossible |
| | | 1.6 mm | 100 kN | 2.7 kN | I.C. |
| | | 2.4 mm | 150 kN | 6 kN | I.C. |
| 139.8 mm | 2 | 4.5 mm | 50 kN | 52 kN | Unnecessary |
| | | 10 mm | 100 kN | 270 kN | S.A. |
| | | 20 mm | 200 kN | 1000 kN | S.A. |
| | 3 | 2.9 mm | 33 kN | 21 kN | I.C. |
| | | 6.2 mm | 66 kN | 100 kN | S.A. |
| | | 10 mm | 100 kN | 270 kN | S.A. |
| 114.3 mm | 2 | 4.5 mm | | | |
| | | 7.5 mm | 50 kN | 200 kN | S.A. |
| | | 20 mm | 100 kN | 1700 kN | S.A. |
| | | (Solid) | 200 kN | None | S.A. |
| | 3 | 2.9 mm | | | |
| | | 4.5 mm | 33 kN | 65 kN | S.A. |
| | | 10 mm | 66 kN | 350 kN | S.A. |
| | | 20 mm | 100 kN | 1700 kN | S.A. |

I.C.: Internal cushioning material
S.A.: Shock absorber

As shown in Table 1, when the outer diameter is 216.3 mm, pipe-like supports with the three thicknesses, i.e., 3.5 mm, 7.5 mm and 12 mm, as used singly, achieve a total load of 100 to 300 kN or more. The support with a thickness of 3.5 mm or 7.5 mm can be made capable of withstanding a load of 300 kN or more by adjustment using an internal cushioning material. Therefore, in the case of using support(s) with an outer diameter of 216.3 mm, a thickness of 3.5 to 12 mm at least is applicable. The table also reveals that, when using two pipe-like supports with an outer diameter of 216.3 mm, a thickness of 1.7 to 6 mm at least is applicable.

The table also shows the following: when the outer diameter is 318.5 mm, a thickness of 1.6 to 5 mm at least is applicable in the case of using one pipe-like support, and a thickness of 1.6 to 2.4 mm at least is applicable in the case of using two pipe-like supports; when the outer diameter is 139.8 mm, a thickness of 4.5 to 20 mm at least is applicable in the case of using two pipe-like supports, and a thickness of 2.9 to 10 mm at least is applicable in the case of using three pipe-like supports; and when the outer diameter is 114.3 mm, a thickness of 4.5 to 20 mm at least is applicable in the case of using two pipe-like members, and a thickness of 2.9 to 10 mm at least is applicable in the case of using three pipe-like members.

In Table 1, "S. A. :shock absorber" means that the load that can be withstood was adjusted by disposing a plurality of vehicle impact attenuators as a set. The vehicle impact attenuators installed mainly in the front of such a set are preferably provided with cuts that facilitate separation, as mentioned above. For example, 72 circular through-holes with a diameter of 5 mm can be formed in a row along the circumferential direction of a pipe-like support with an outer diameter of 216.3 mm. Such holes give a void ratio (hole diameter×hole number/support circumference) of about 50% and thereby facilitate separation at the time of fracture. In a vehicle impact attenuator whose support is preferably separated at the time of fracture, it is desirable that the void ratio of the pipe-like support be 40 to 90%.

Fifth Embodiment

Figure 15:
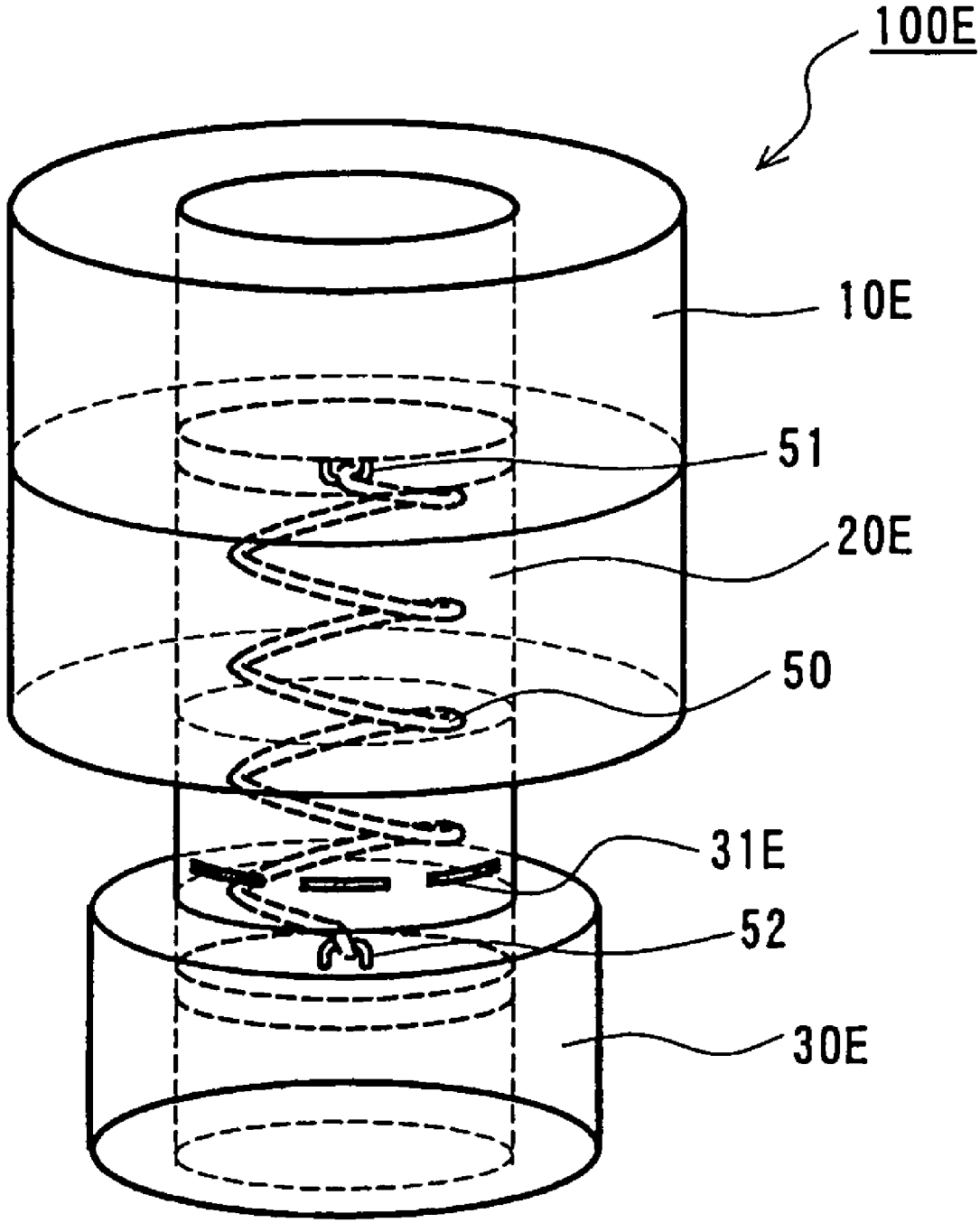
FIG. 15 is a perspective view illustrating a vehicle impact attenuator according to a fifth embodiment of the present invention.

FIG. 15 is a perspective view of a vehicle impact attenuator according to a fifth embodiment of the present invention. Like the vehicle impact attenuator 100B shown in FIG. 5, this vehicle impact attenuator 100E comprises a shock absorber 10E, a support 20E, a holding portion 30E and cuts 31E, and further comprises a helical coil 50 inside the support 20E. Like in the vehicle impact attenuator 100B shown in FIG. 5, the support 20E has deformation strength that allows the support to be plastically deformed by a load less than a set value, and the cuts 31E have a breaking strength such that they serve as fracture starting points when receiving a load equal to or exceeding a predetermined value, to thereby release the support 20E.

The coil 50 is a circular coil comprising approximately concentric circular turns (windings). The coil 50 is made of metal, such as iron, which is not elastic and is plastically deformable by a load equal to or exceeding a predetermined value. Examples of usable materials of the coil 50 include mild steel, such as structural steel.

The coil 50 has a hook on each end. The support 20E has first and second fixing members 51, 52 in its interior, the fixing members 51, 52 being disposed above and below the cuts 31E and having an opening. The hooks of the coil 50 are each hooked to the opening of the first and second fixing members 51, 52.

Figure 16:
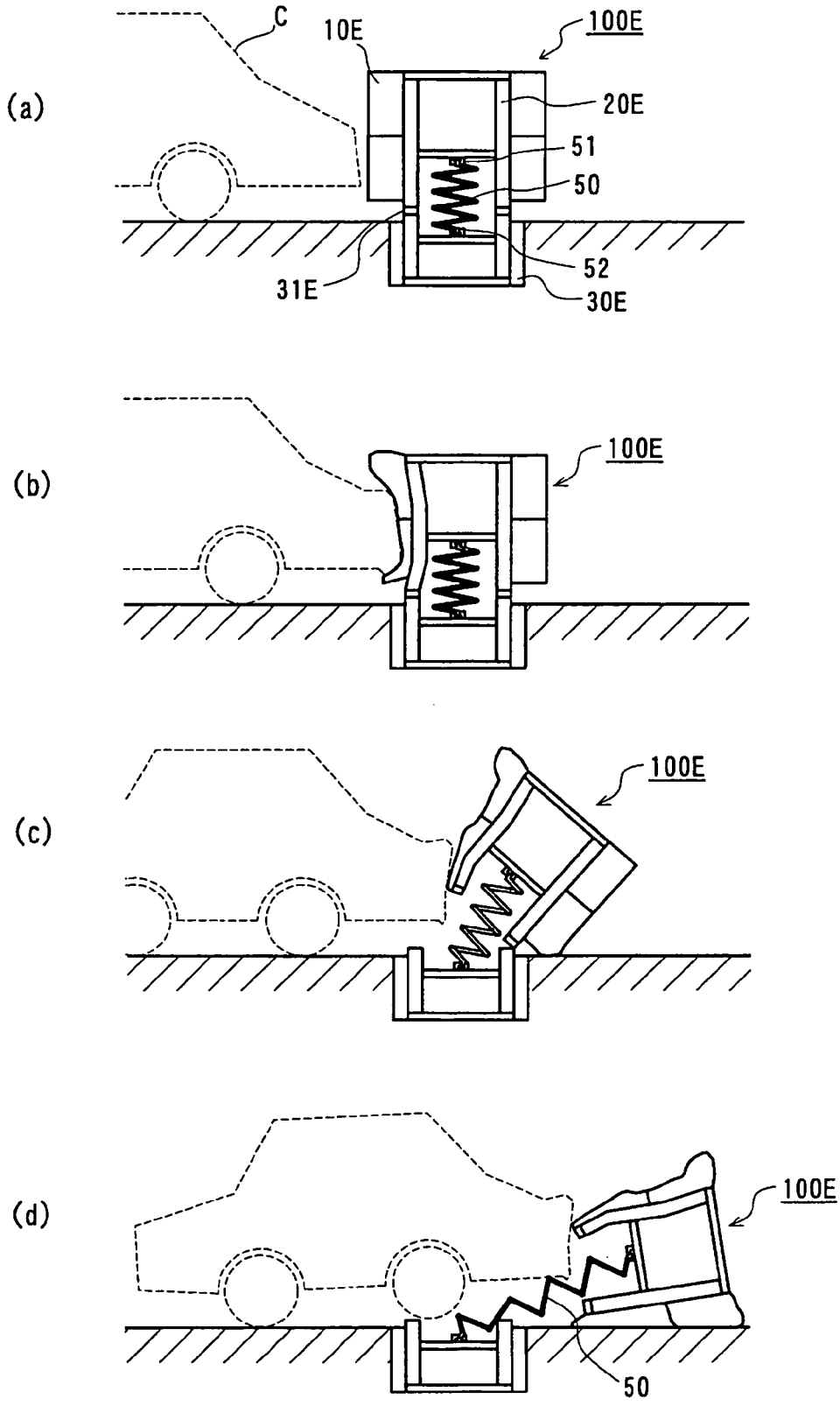
FIG. 16 is a series of longitudinal sectional views illustrating the deformation of the vehicle impact attenuator illustrated in FIG. 15 at the time of a vehicle collision.

FIG. 16 shows the deformation of the vehicle impact attenuator 100E according to this embodiment thus constructed, at the time of a collision with a vehicle C. When the vehicle C collides, the vehicle impact attenuator 100E, originally in the state shown in FIG. 16(*a*), first absorbs the impact by the deformation of the shock absorber 10E and the plastic deformation of the support 20E, as shown in (*b*). Subsequently, the impact is absorbed while the support 20E is fractured into two pieces, with the cuts 31E serving as fracture starting points, as shown in (*c*). Further, if the vehicle C retains kinetic energy even after the upper part of the support 20E has been completely separated from the lower part, the kinetic energy of the vehicle is absorbed while the upper part of support 20E is moved by the vehicle C, namely, during the plastic deformation of the coil 50 by the force applied by the vehicle C.

Figure 17:
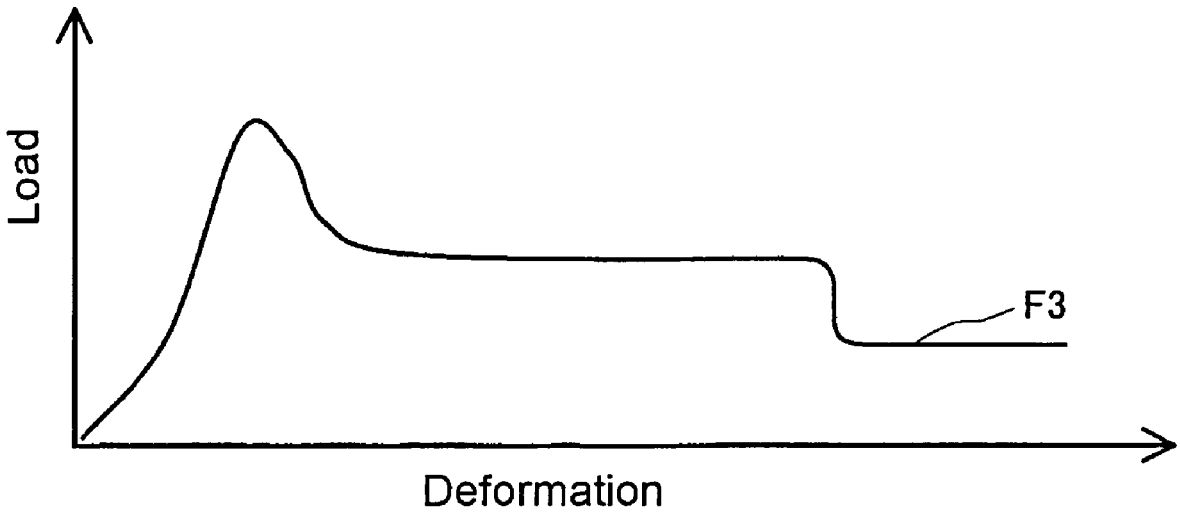
FIG. 17 is a graph schematically showing the relation between the displacement and load of a pressure-applying end pressed against the vehicle impact attenuator illustrated in FIG. 15.

The vehicle impact attenuator 100E according to this embodiment is preferable, since the impact is absorbed approximately continuously during the impact absorbing process by the coil 50 shown in (*d*), unlike other embodiments. FIG. 17 is a graph schematically showing, like FIG. 14, the relation between the displacement and load of the pressure-applying end, with respect to the vehicle impact attenuator according to this embodiment. In FIG. 17, F3 indicates that, after an impact absorption similar to that indicated in FIG. 14 is complete, the impact is continuously absorbed by the coil. In FIG. 17, the curve continues to the right as long as the coil 50 can extend.

A spring with high elasticity, such as an ordinary steel spring, can absorb vehicle impact energy continuously, but exhibits a large restoring force after the deformation and may cause a secondary accident. In contrast, the coil 50 in this embodiment is made of a material that has low elasticity and requires a load equal to or exceeding a predetermined value for plastic deformation, and therefore has a very small restoring force and is very unlikely to cause a secondary accident.

In the above explanation, the coil 50 is a circular coil, but it is not limited thereto as long as it is a wire-like member that is made of a plastically deformable material, requires a load equal to or exceeding a predetermined value for extension, and is placed inside the support 20E. For example, each turn of the coil 50 may be of any shape, including an oval, an equilateral or inequilateral polygon, etc.; the turns may vary in size; or the coil may be a folded wire-like member.

The means and positions to attach the ends of the coil 50 to the support 20E are not limited, as long as the ends of the coil 50 are positioned above and below the cuts 31E and attached to the support 20E. For example, the body of the coil 50 may be placed in the support 20E and below the holes 31E. In such a case, the space in the support 20E and above the holes 31E may be filled with a cushioning material. The coil 50 may also be attached outside the support 20E. In such a case, the vehicle impact attenuator 100E is preferably installed in such a manner that the coil 50 is positioned in the back of the support 20E as seen from the expected colliding vehicle.

While a detailed explanation of embodiments of the present invention has been given, the present invention is not limited to the first to fifth embodiments, and various additions and modifications can be made thereto. For example, reflective stickers, lights or the like (not shown), which can prevent vehicle collisions by visual effects, may be installed together with the vehicle impact attenuator.

EXAMPLE 2

Figure 18:
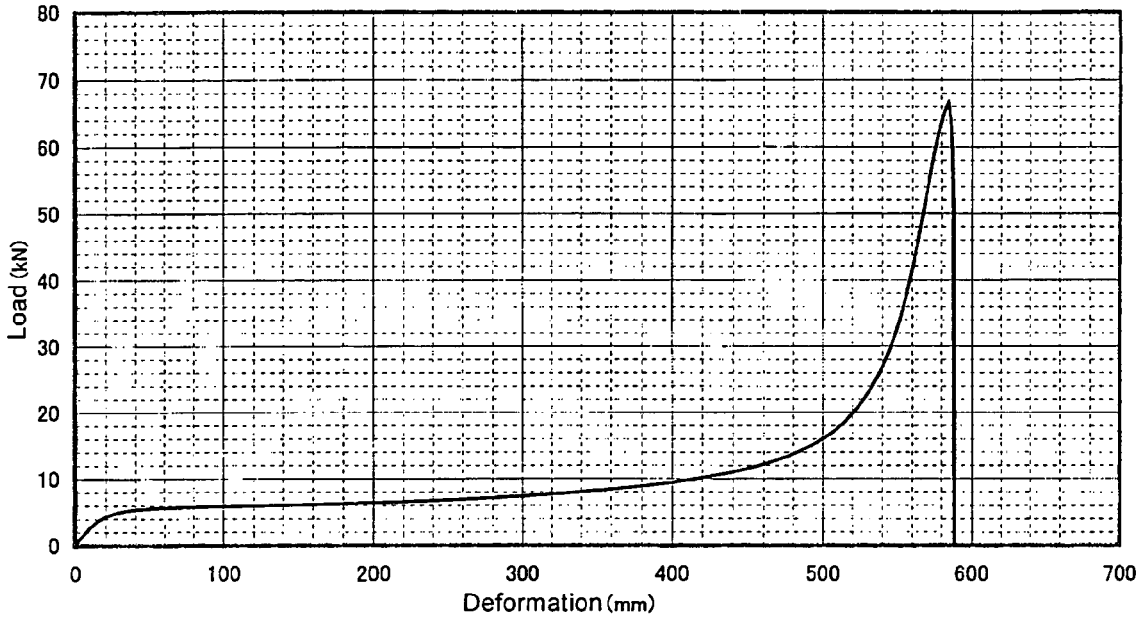
FIG. 18 shows graphs indicating measurement results on the coil used in the vehicle impact attenuator illustrated in FIG. 15 to absorb the load of a collision.
Figure 18:
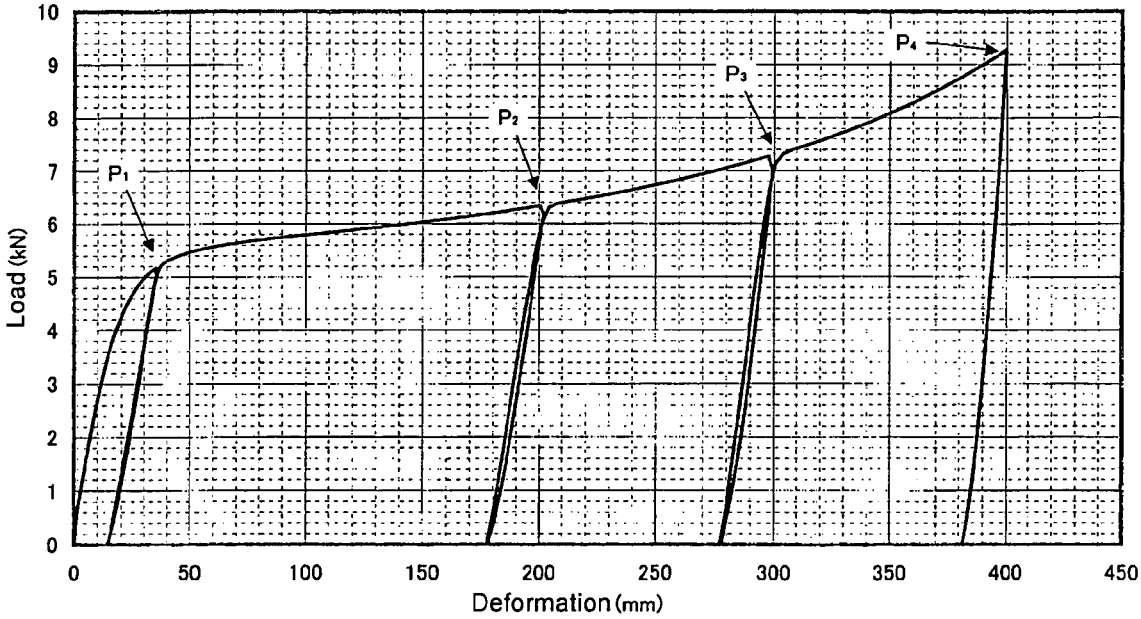

FIG. 18 is a pair of graphs showing the results of an experiment on the coil 50 for use in the vehicle impact attenuator 100E of the fifth embodiment. The coil used in the experiment is made of structural steel, comprises turns with a coil diameter D of about 62 mm, and has a wire diameter d of about 12 mm and a number of turns Na of 3.

FIG. 18(*a*) shows the results of deforming the coil by continuously applying a force to its ends at a deformation rate of about 200 mm/min until the coil is fractured. In graph(a), the load is plotted as ordinate against the deformation as abscissa. The graph shows that the load was substantially stabilized in the range of 5 kN to 10 kN, demonstrating that the energy was efficiently absorbed.

According to JIS B 2704, $$\tau_0=8DP/(\pi d^3) \quad \text{(Equation 1)}$$

$$\tau=\kappa\tau_0 \quad \text{(Equation 2)}$$

wherein $\tau_0$ is a torsional stress, $\tau$ is a torsion correction stress, P is a load and $\kappa$ is a stress correction factor.

From Equations 1 and 2, $$P=(\pi d^3\tau)/(8D\kappa) \quad \text{(Equation 3)}$$

wherein $\kappa=(4c-1)/(4c-4)+0.615/c$, and $c=D/d$.

The experimental results shown in (a) are substituted in Equation 3 to find the range of $\tau$ in which the load is stabilized. Since c=5.17 and $\kappa$=1.3, when P=5 (kN), $\tau=(8D\kappa P)/(\pi d^3)=594$ (N/mm$^2$); and when P=10 (kN), $\tau=(8D\kappa P)/(\pi d^3)=1180$ (N/mm$^2$). Therefore, the energy can be efficiently absorbed when $\tau$ is 60.5 to 121 (N/mm$^2$).

Further, since an acceleration of about 30 to 150 m/s$^2$ is generated at the time of a collision of a 1-ton vehicle, a vehicle impact attenuator with ideal strength to absorb energy can be realized by determining a coil diameter D and wire diameter d of the coil that yield an impact load P of about 30 kN to 150 kN by reverse calculation. For example, when using structural steel for the coil, a coil diameter D of 110 to 130 (mm) and a wire diameter d of 30 to 40 (mm) yield an impact load P of about 40 kN to 80 kN.

In addition to these conditions, when the number of turns Na is three or more, the distance required to absorb the energy of the vehicle, i.e., the distance required for the coil to be substantially fully extended, is about 1 m or more, which is practical. Further, when the number of turns Na is 20 or less, the coil can be placed in the support with a practical height of about 600 mm.

FIG. 18(*b*) shows the results of an experiment on deformation of a coil of the same size and material as in the above experiment (graph (a)) by applying a force at the same deformation rate as in the above experiment, except that the load was released four times (at points P1 to P4) during deformation before fracture. The scale of the ordinate of graph (b) is enlarged as compared with that of graph (a). In graph (b), the load is decreased to 0 at points P1 to P4, and the coil is restored only about 20 mm at each time. This suggests that when a coil is made of a material that has low elasticity and requires a load equal to or exceeding a predetermined value for plastic deformation (e.g., mild steel, including structural steel), the coil can continuously absorb energy due to its plasticity, and exhibits an extremely small restoring force, therefore making it very unlikely to cause a secondary accident.

INDUSTRIAL APPLICABILITY

The present invention provides a vehicle impact attenuator that can be installed at low cost, immediately stop a colliding vehicle, and effectively mitigate the impact on the vehicle.

The invention claimed is:

1. A vehicle impact attenuator comprising:

a shock absorber that deforms upon a collision of a vehicle to thereby reduce the impact on the vehicle;

a support for the shock absorber; and a holding portion that holds the support in a vertical position in an installation area;

the support or the holding portion having a release portion that fractures upon application of a load equal to or exceeding a set value, to thereby release the support from being held in a vertical position in the installation area, the support being plastically deformable by a load lower than the set value, the support being a pipe-like member which has an outer diameter of 114.3 to 318.5 mm and a wall thickness of 1.6 to 20 mm, the plastic deformation occurs as a flattening of the pipe-like member, and the yield point load that causes the flattening as the plastic deformation of the support being not less than 25 kN and not more than 800 kN.

2. The vehicle impact attenuator according to claim 1, wherein:

the holding portion comprises a connecting portion fixed on a lower part of the support, and anchor bolts that are implanted in the installation area to thereby hold the connecting portion in the installation area and that function as the release portion;

the anchor bolts being capable of fracturing upon application of a load equal to or exceeding the set value.

3. The vehicle impact attenuator according to claim 1, wherein:

the holding portion comprises a burying hole formed in the installation area to accommodate a lower part of the support;

the support is a pipe-like member provided with cuts that are positioned above the installation area when the support is accommodated in the burying hole; and the cuts serve as fracture starting points when a load equal to or exceeding the set value is applied, and function as the release portion.

4. The vehicle impact attenuator according to claim 1, wherein:

a coil that plastically deforms upon application of a load equal to or exceeding a predetermined value is further provided;

the holding portion comprises a burying hole formed in the installation area to accommodate a lower part of the support;

the support is a pipe-like member that plastically deforms upon application of a load lower than the set value;

the ends of the coil are positioned above and below the release portion and attached to an upper part of the support, which is released by the vehicle collision, and to the holding portion or a lower part of the support, which remains held after the vehicle collision.

5. The vehicle impact attenuator according to claim 4, wherein the coil has a helical shape comprising approximately circular turns;

the coil having a coil diameter of not less than 110 mm and not more than 130 mm, a wire diameter of not less than 30 mm and not more than 40 mm, and a number of turns of not less than 3 and not more than 20; and the coil being made of structural steel.

6. The vehicle impact attenuator according to claim 1, wherein:

a plurality of the supports are held adjacent to each other in the installation area; and the shock absorber is supported by all of the supports.

7. The vehicle impact attenuator according to any one of claims 3, 4, wherein:

the support is accommodated in the burying hole and comprises a fitting member that engages and holds a lower part of the support; and the fitting member has strength sufficient to approximately retain its original shape after the fracture of the release portion.

8. The vehicle impact attenuator according to any one of claims 2, 4, wherein:

the set value for the fracture of the release portion is not less than 50 kN and not more than 900 kN.

9. The vehicle impact attenuator according to claim 8, wherein the pipe-like member is made of iron or plastic;

the pipe-like member having an outer diameter of not less than 100 mm and not more than 800 mm; and a wall thickness of not less than 0.8 mm and not more than 100 mm.

10. The vehicle impact attenuator according to any one of the claims 2 and 5 wherein the pipe-like member contains an internal cushioning material.

* * * * *